US008579591B2

(12) United States Patent
Ho et al.

(10) Patent No.: US 8,579,591 B2
(45) Date of Patent: Nov. 12, 2013

(54) CENTRIFUGAL COMPRESSOR IMPELLER

(75) Inventors: John Chen Chiang Ho, San Diego, CA (US); Bo Zheng, San Diego, CA (US); Timothy M. Hollman, San Diego, CA (US); Kevin K. Taft, La Mesa, CA (US); Jang Y. Jo, Chula Vista, CA (US); Anthony C. Jones, San Diego, CA (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 643 days.

(21) Appl. No.: 12/914,335

(22) Filed: Oct. 28, 2010

(65) Prior Publication Data

US 2012/0107131 A1 May 3, 2012

(51) Int. Cl.
*F01D 5/04* (2006.01)
*F01D 5/14* (2006.01)

(52) U.S. Cl.
USPC ..... 416/203; 416/DIG. 2; 416/DIG. 5; 29/888.024

(58) Field of Classification Search
USPC ..... 416/175, 203; 29/889.23, 888.024
See application file for complete search history.

(56) References Cited

U.S. PATENT DOCUMENTS

| | | | | |
|---|---|---|---|---|
| 4,981,018 | A * | 1/1991 | Jones et al. | 60/726 |
| 6,905,310 | B2 | 6/2005 | Kawamoto | |
| 7,784,181 | B2 * | 8/2010 | Nocciolini et al. | 29/889.23 |
| 7,862,304 | B2 * | 1/2011 | Saindon et al. | 416/223 A |
| 8,167,540 | B2 * | 5/2012 | Schlinker et al. | 415/119 |
| 8,523,530 | B2 * | 9/2013 | Merritt et al. | 416/223 B |
| 2009/0191047 | A1 | 7/2009 | Schlinker | |
| 2010/0215978 | A1 | 8/2010 | Rice | |
| 2011/0067240 | A1 * | 3/2011 | Prust et al. | 29/889.23 |

FOREIGN PATENT DOCUMENTS

EP 0205001 A1 12/1986

* cited by examiner

*Primary Examiner* — Nathaniel Wiehe
*Assistant Examiner* — Ryan Ellis
(74) *Attorney, Agent, or Firm* — Kinney & Lange, P.A.

(57) ABSTRACT

A compressor impeller includes a hub, main blades and splitter blades. The main blades are equally spaced around the circumference of the hub. Each splitter blade is equally spaced between two adjacent main blades. Each main blade and splitter blade has suction and pressure surfaces formed in substantial compliance with normalized Cartesian coordinate values of X, Y, and Z set forth in Tables 1-4. When connected by smooth, continuing arcs, the normalized Cartesian coordinates form complete main blade and splitter blade shapes that are substantially matched by the main blade and splitter blade shapes of the compressor impeller.

12 Claims, 6 Drawing Sheets

CENTRIFUGAL COMPRESSOR IMPELLER

STATEMENT OF GOVERNMENT INTEREST

This invention was made with government support under Contract No. N00019-06-C-0081, Sub-Contract No. 4500019224 awarded by the United States Navy. The government has certain rights in the invention.

BACKGROUND

The present invention relates to gas turbine engines. In particular, the invention relates to a centrifugal compressor impeller for use in gas turbine engines.

Gas turbine engines generally comprise a compressor and a turbine wheel. Smaller gas turbines often employ a centrifugal compressor, due to its inherent space efficiency. The primary component of a centrifugal compressor is a compressor impeller. The compressor impeller compresses incoming air which is directed through a diffuser to a combustion chamber, mixed with fuel and ignited. The turbine wheel is propelled by rapidly expanding gases resulting from the combustion of the fuel and the compressed incoming air. The compressor impeller is linked to, and powered by, the turbine wheel.

Overall gas turbine engine cycle efficiency is determined in part by a compression ratio (air pressure exiting the compressor divided by the air pressure entering the compressor). The higher the compression ratio, the higher the gas turbine engine cycle efficiency. The compression ratio is a function of the efficiency of the compressor and compressor impeller. The greater the compression ratio for a given flow rate and work factor, the more efficient the compressor impeller.

SUMMARY

The present invention concerns a compressor impeller. The compressor impeller has a hub, a plurality of main blades and a plurality of splitter blades. Each of the main blades is equally spaced around the circumference of the hub and each of the splitter blades is equally spaced between two adjacent main blades.

Each of the main blades has a suction surface formed in substantial conformance with normalized Cartesian coordinate values of X, Y, and Z set forth in Table 1 and a pressure surface formed in substantial conformance with normalized Cartesian coordinate values of X, Y, and Z set forth in Table 2. Each of the splitter blades has a suction surface formed in substantial conformance with normalized Cartesian coordinate values of X, Y, and Z set forth in Table 3 and a pressure surface formed in substantial conformance with normalized Cartesian coordinate values of X, Y, and Z set forth in Table 4. When connected by smooth, continuing arcs, the normalized Cartesian coordinates form complete main blade and splitter blade shapes that are substantially matched by the main blade and splitter blade shapes of the compressor impeller.

DETAILED DESCRIPTION

Conventional centrifugal compressor impellers in gas turbine engines are not efficient enough for higher performance auxiliary power units required to meet performance targets for new aircraft. Conventional centrifugal compressor impeller blade geometries do not generate the compression ratios necessary to achieve the required performance for a given air flow rate. Thus, an improved impeller design able to produce a higher compression ratio for a given air flow rate would significantly improve the efficiency of a gas turbine engine. The present invention includes novel compressor impeller blade geometries that result in an increase in the compression ratio for a given air flow rate. The present invention is scalable and, therefore, best described in normalized units to permit application in a wide variety of gas turbine engine sizes.

Figure 1:
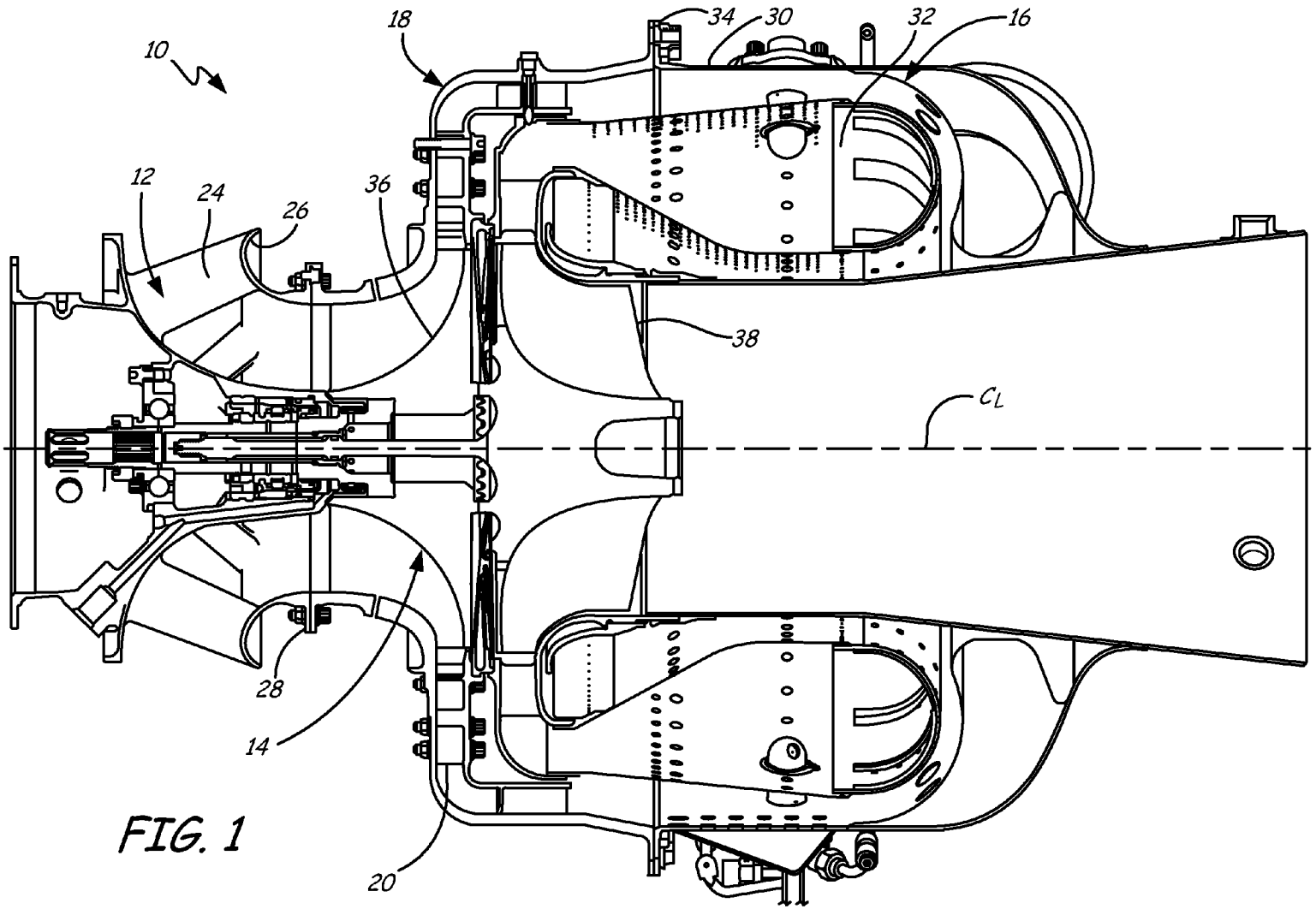
FIG. 1 is a side view of a gas turbine engine.

FIG. 1 illustrates a gas turbine engine incorporating the present invention. The figures show gas turbine engine 10 includes air inlet 12, rotor assembly 14, combustor assembly 16, compressor shroud 18, and diffuser 20. Air inlet 12 includes forward inlet 24, bell mouth 26, and forward inlet flange 28. Combustor assembly 16 includes combustor housing 30, combustor chamber 32, and combustor flange 34. Rotor assembly 14 includes compressor impeller 36 and turbine wheel 38.

Air inlet 12 attaches to compressor impeller 36 and to turbine wheel 38 of rotor assembly 14 along centerline axis $C_L$, connecting compressor impeller 36 to turbine wheel 38. Compressor shroud 18 axially surrounds compressor impeller 36 and diffuser 20. A first flanged end of compressor shroud 18 coextensive with an end of compressor impeller 36 farthest from turbine wheel 38, attaches to air inlet 12 at forward inlet flange 28. Forward inlet flange 28 is adjacent to bell mouth 26, which contains forward inlet 24. A second flanged end of compressor shroud 18 coextensive with an end of turbine wheel 38 farthest from compressor impeller 36, attaches to combustor assembly 16 at combustor flange 34. Combustor flange 34 is adjacent to combustor housing 30, which contains combustion chamber 32.

In operation, air enters forward inlet 24 of air inlet 12 at bell mouth 26 and is compressed by the centrifugal action of compressor impeller 36. The compressed air is directed by compressor shroud 18, through diffuser 20, and into combustor housing 30 where it mixes with fuel and is ignited to produce a flame in combustor chamber 32. Diffuser 20 comprises a series of impediments to air flow, such as angled vanes, to slow the compressed air, and increase its pressure, thereby preventing the compressed air from blowing out the flame in combustion chamber 32. High temperature gases produced by the flame expand rapidly and propel turbine wheel 38. Turbine wheel 38 drives compressor impeller 36 by way of a coupling between turbine wheel 38 and compressor impeller 36.

The thermodynamic efficiency of any turbine engine depends on the compression ratio, defined as the ratio of the air pressure measured at forward inlet 24 and the air pressure measured aft of diffuser 20. In general, higher overall compression ratios offer increased efficiency and improved engine performance. Overall engine performance thus depends upon the ability of compressor impeller 36 to produce a higher compression ratio for a given air flow rate and work factor.

Figure 2:
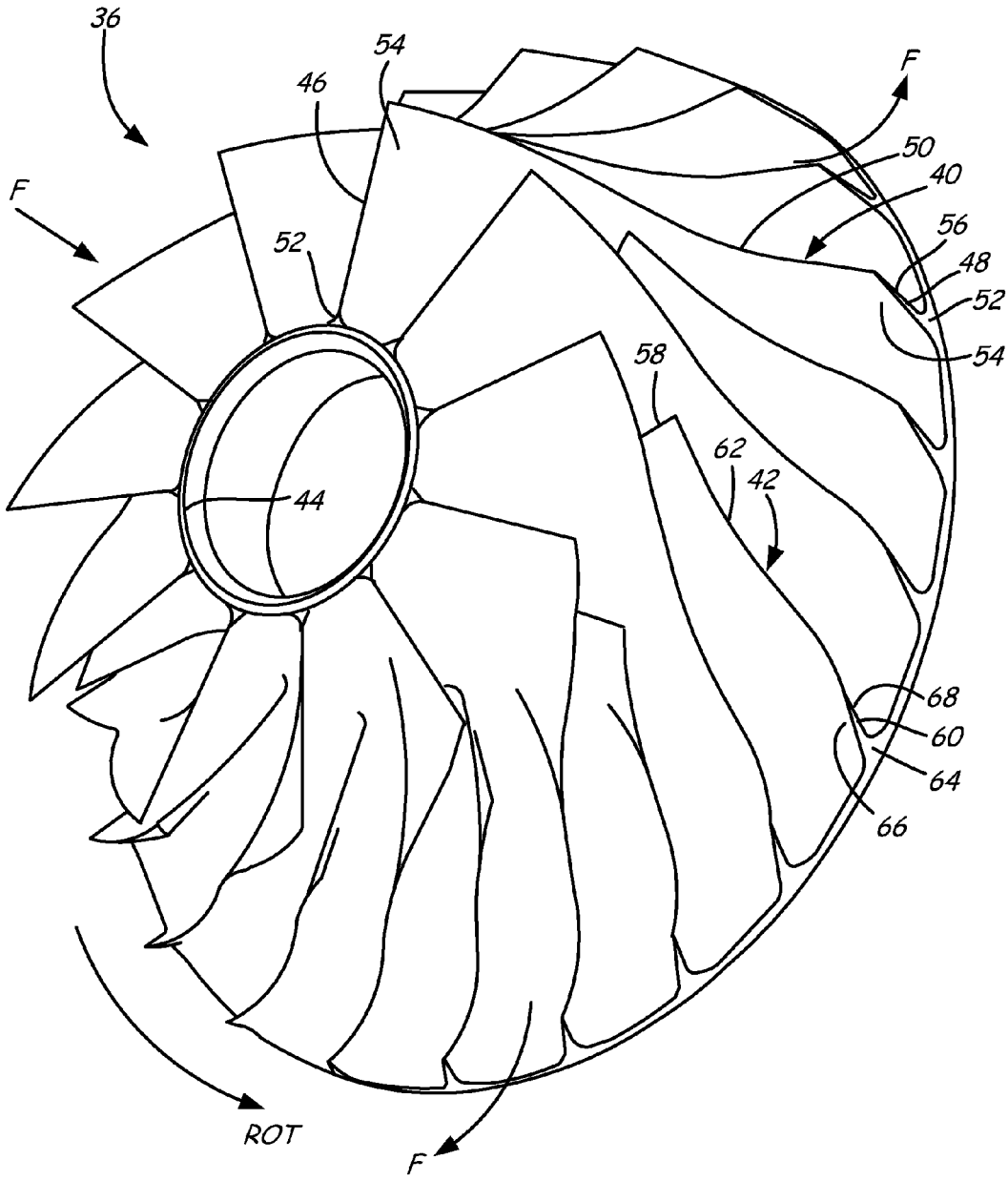
FIG. 2 is a perspective view of the compressor impeller used in the gas turbine engine of FIG. 1.

FIG. 2 is a perspective view of compressor impeller 36 of the present invention used in gas turbine engine 10 of FIG. 1. FIG. 2 shows compressor impeller 36 comprises eleven main blades 40, eleven splitter blades 42 and impeller hub 44. Each of eleven main blades 40 is substantially identical to each other and comprises leading edge 46, trailing edge 48, blade tip 50, blade root 52, suction side 54, and pressure side 56. Similarly, each of eleven splitter blades 42 is substantially identical to each other and comprises leading edge 58, trailing edge 60, blade tip 62, blade root 64, suction side 66, and pressure side 68. Hub 44 is accommodates an impeller shaft (not shown) connecting compressor impeller 36 to air inlet 12.

Main blades 40 are machined such that they are evenly distributed around the circumference of hub 44. Similarly, splitter blades 42 are also machined such that they too are evenly distributed around the circumference of hub 44. Each splitter blade 42 is between two adjacent main blades 40 at a point generally equidistant from two adjacent main blades 40.

Figure 3A:
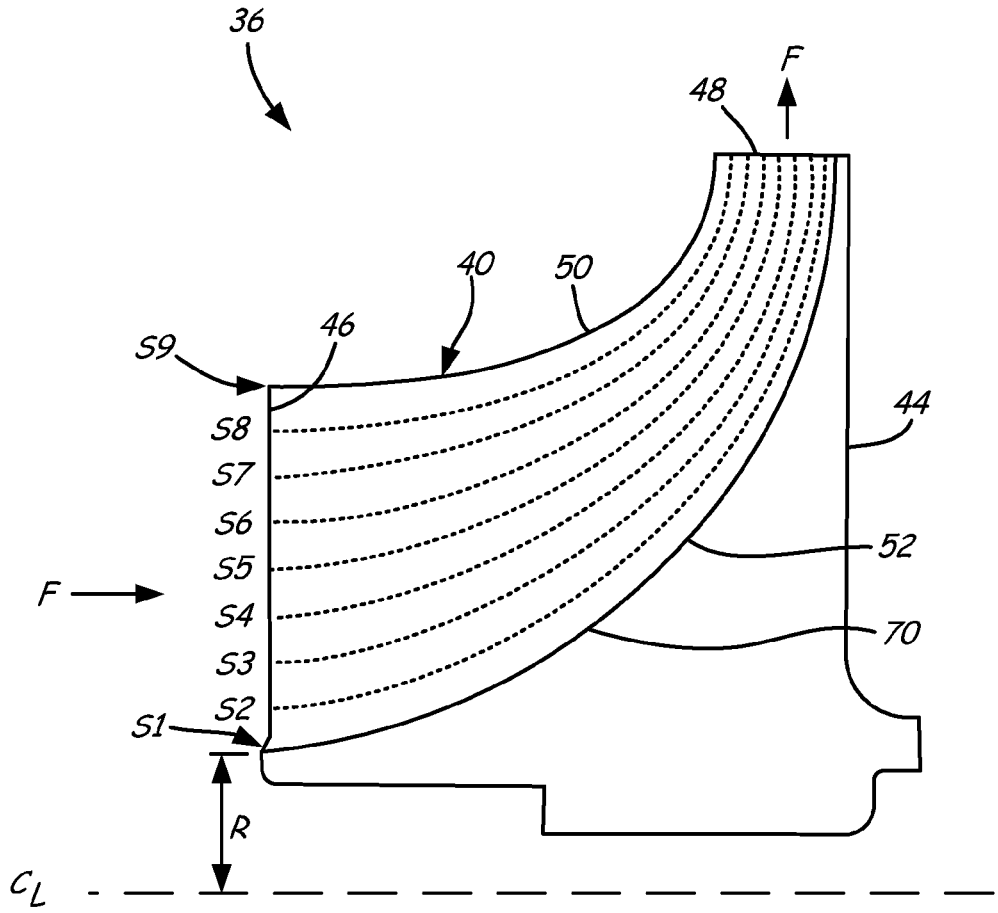
FIGS. 3A and 3B are schematic meridonal cross-section views of one half of the compressor impeller of FIG. 2 illustrating a main blade and a splitter blade, respectively.
Figure 3B:
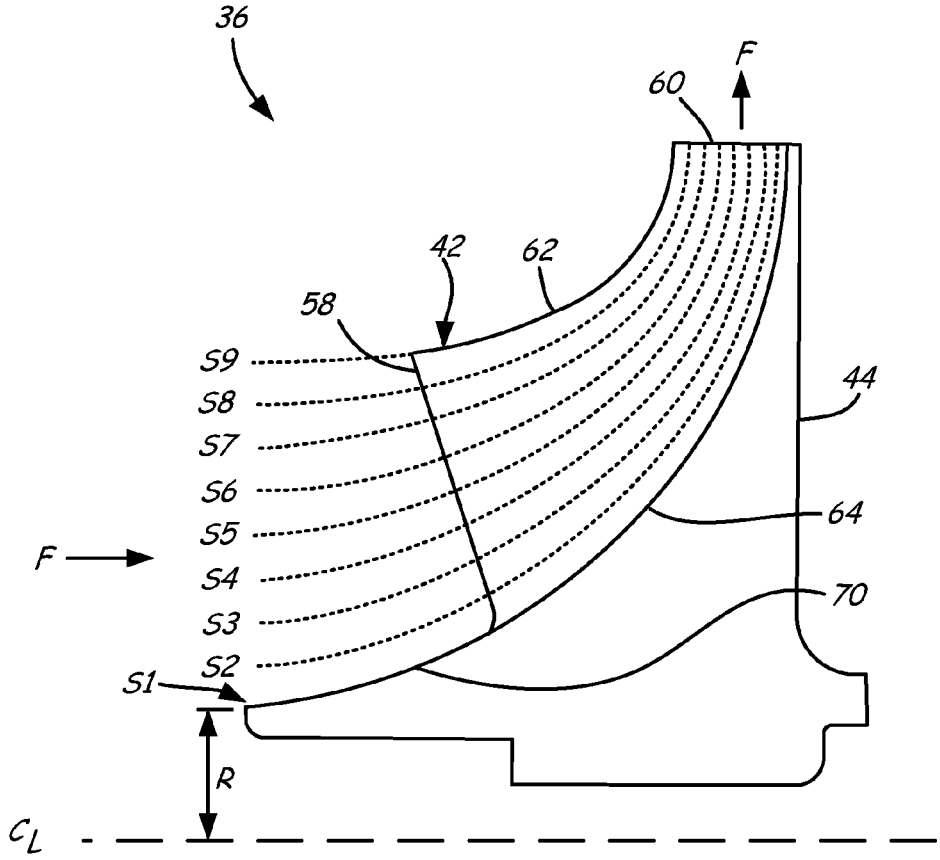

FIGS. 3A and 3B are schematic cross-section views of one half of compressor impeller 36 of FIG. 2 illustrating main blade 40 and splitter blade 42, respectively. In FIGS. 3A and 3B, the shape of hub 44 is more clearly seen, including hub surface 70. Compressor impeller 36 is machined from a single piece of forged metal, for example, titanium, that has initially been machined to a near net shape of compressor impeller 36. The near net shape is a shape approximating compressor impeller 36, but without any blades defined. The single piece of forged metal is drilled to define a portion of hub 44 that will accommodate an impeller shaft. Main blades 40 (FIG. 3A) and splitter blades 42 (FIG. 3B) are machined from the single piece of forged metal. Machining can be performed using, for example, a five-axis machining center or computer-controlled machining system capable of positioning control in five independent axes. This operation also necessarily defines hub surface 70 of hub 44. FIGS. 3A and 3B also illustrate center line $C_L$ about which compressor impeller 36 rotates and a radius R of compressor impeller 36. Radius R is the radial distance between $C_L$ and hub surface 70 at the most forward, or upstream, point of hub surface 70.

Operation is best described by considering FIGS. 2, 3A, and 3B together. In operation, as compressor impeller 36 rotates in the direction shown by arrow ROT in FIG. 2, air proximate pressure side 56 of main blade 40 increases in pressure and air proximate suction side 54 decreases in pressure. As a result, the air is forced by main blades 40 along a flow channel defined by adjacent main blades 40 and hub surface 70. Air flow F flows in a generally axial direction as it enters compressor rotor 36 at leading edge 46. As air flow F flows through the flow channel it is accelerated in a more radial direction by hub surface 70, which, as can be seen from FIGS. 3A and 3B, has a generally frustoconical shape. At trailing edge 48, air flow is in a generally radial direction and has been accelerated to a high radial velocity.

As shown in FIG. 2, main blades 40 are oriented such that they are angled in the direction of rotation. This tends to reduce the pressure difference between suction surface 54 and pressure surface 56. This is important because if the pressure difference becomes large enough, the flow of air flow F will separate from suction surface 54 resulting in greater impeller inefficiency. However, as the flow channel defined by adjacent main blades 40 and hub surface 70 moves aft, the distance between adjacent main blades 40 becomes larger due to the general frustoconical shape of hub 44 and the tendency for flow separation increases. This effect is countered by splitter blade 42. Splitter blade 42 splits the flow channel into two smaller flow channels with each flow path defined by main blade 40, adjacent splitter blade 42, and hub surface 70. The shorter distance between adjacent blades reduces the tendency of the air flow to separate from the suction side, either suction surface 54 or suction surface 66, enhancing efficiency.

Figure 4:
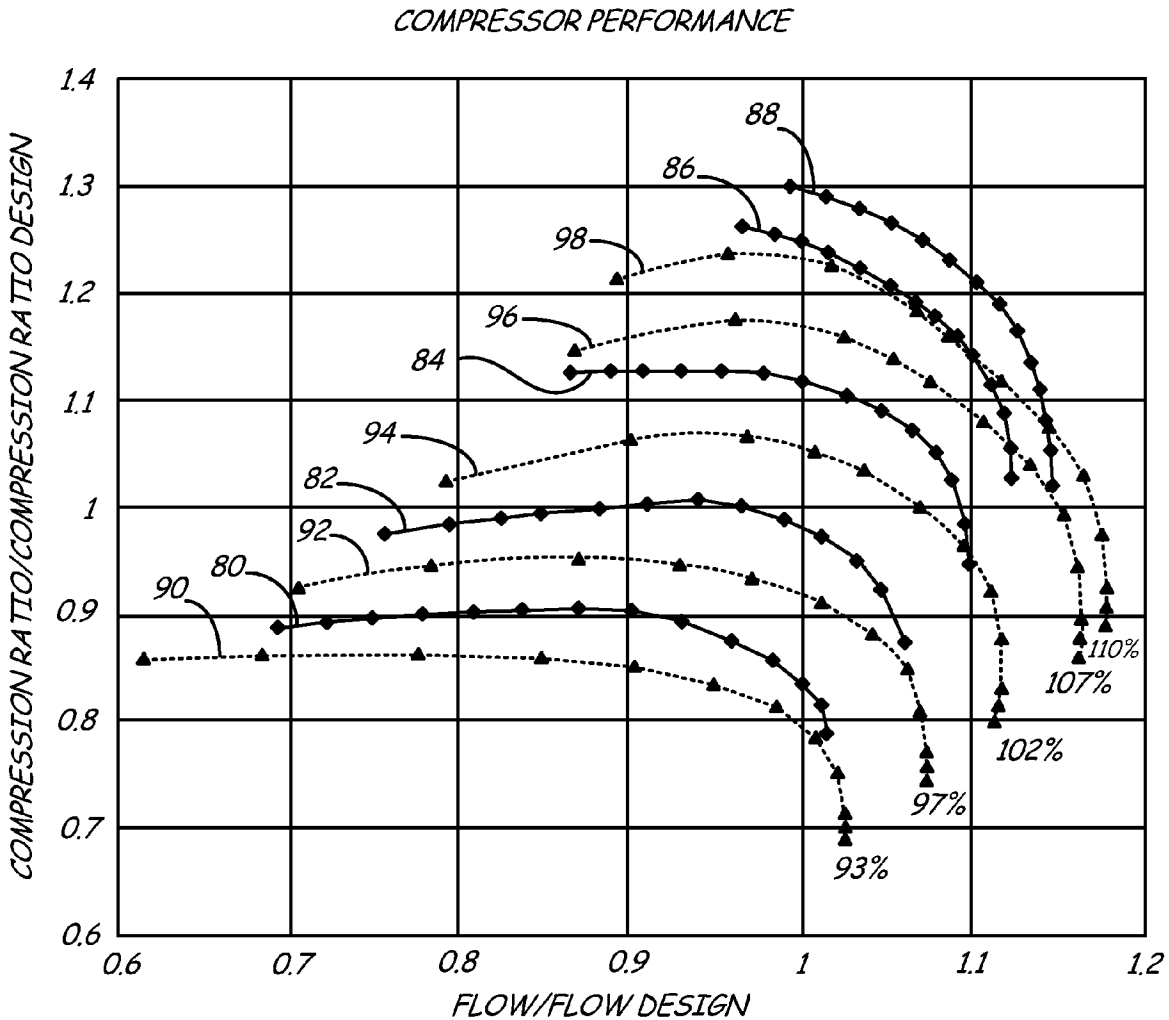
FIG. 4 illustrates the compression ratio achieved by a compressor employing the compressor impeller of the present invention compared to a state of the art compressor.
Figure 5:
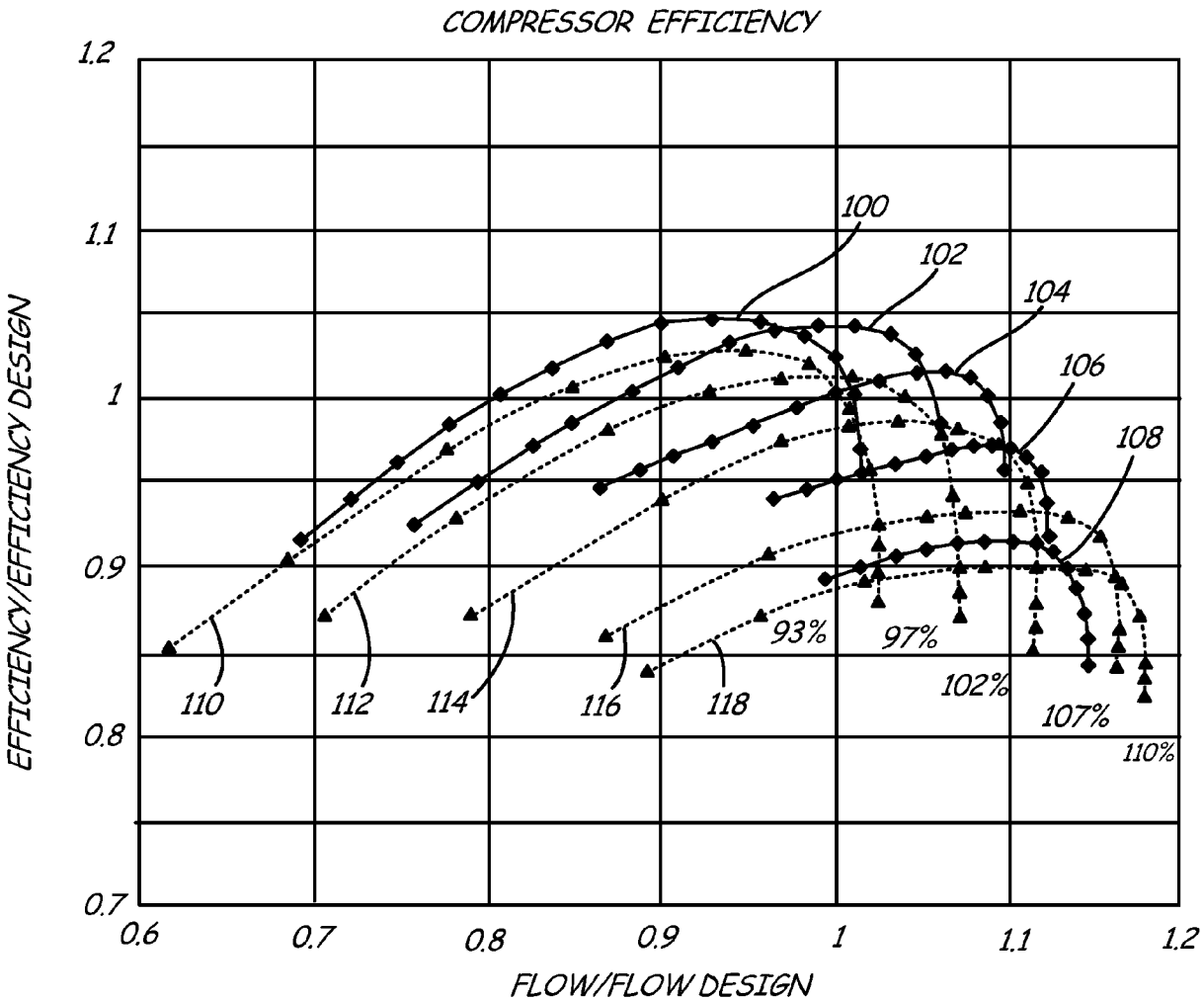
FIG. 5 illustrates the thermodynamic efficiency of the compressor employing the compressor impeller of the present invention compared to a state of the art compressor.

Efficiency of compressor impeller 36 is further enhanced by shaping main blade 40 and splitter blade 42 to create improved air flow patterns. The main blade 40 and splitter blade 42 in the present invention comprise novel blade shapes that significantly improve the efficiency of compressor impeller 36 over the prior art. FIGS. 4 and 5 illustrate the extent of this efficiency improvement. Curves 80, 82, 84, 86, and 88 of FIG. 4 show the compression ratio achieved by a compressor employing compressor impeller 36 of the present invention compared to curves 90, 92, 94, 96, and 98 which show the compression ratio of a state of the art compressor for various air flow values. A pair of curves (e.g. curve 80 and curve 90) is generated for various values of full design rotational speed, where 100% represents full design rotational speed. Both axes are normalized by design target values. For example, curve 80 illustrates the performance of the compressor employing compressor impeller 36 at 93% of full compressor impeller design speed. Curve 90 illustrates the performance of a state of the art compressor at the same speed. All points of curve 80 are above curve 90 indicating improved performance over a range of air flows. As shown in FIG. 4, a compressor employing the compressor impeller of the present invention achieves significantly better compression ratios for air flow rates below, at, and above the design flow rate.

FIG. 5 illustrates the thermodynamic efficiency achieved by a compressor employing compressor impeller 36 of the present invention compared to a state of the art compressor impeller over various air flow rates at various values of full design rotational speed. The efficiency represents the ratio of the theoretical amount of work required by a compressor divided by the actual amount of work required by the compressor. Both axes are normalized by design target values. Curves 100, 102, 104, 106, and 108 of FIG. 5 show the efficiency achieved by a compressor employing compressor impeller 36 of the present invention compared to curves 110, 112, 114, 116, and 118 which show the efficiency of a state of the art compressor impeller for various air flow values. A pair of curves (e.g. curve 100 and curve 110) is generated for various values of full design rotational speed, where 100% represents full design rotational speed. Both axes are normalized by design target values. For example, curve 100 illustrates the efficiency of the compressor employing compressor impeller 36 at 93% of full compressor impeller design speed. Curve 110 illustrates the performance of a state of the art compressor at the same speed. Almost all points of curve 100 are above curve 110 indicating improved performance over a range of air flows. As with FIG. 4, FIG. 5 demonstrates the superior performance of the compressor impeller of the present invention over a state of the art compressor impeller, especially at and below the design flow rate.

As mentioned above, the present invention is scalable and, therefore, best described in normalized units to permit application in a wide variety of gas turbine engine sizes. Tables 1 and 2 describe in detail the novel shape of main blade 40 using normalized Cartesian coordinates. Table 1 describes the shape of suction surface 54 and Table 2 describes shape of pressure surface 56. Similarly, Tables 3 and 4 describe in detail the novel shape of splitter blade 42 using normalized Cartesian coordinates. Table 3 describes the shape of suction surface 66 and Table 4 describes shape of pressure surface 68. Each Table contains coordinates defining the designated blade surface along one of nine blade sections, S1-S9, as illustrated in FIGS. 3A and 3B. Blade sections S1-S9 are distributed at one eighth intervals along the span of main blade 40 (FIG. 3A) and splitter blade 42 (FIG. 3B) from minimal span 51 proximate blade root 52 and blade root 64, respectively to maximum span S9 proximate blade tip 50 and blade tip 62, respectively, as shown. The Cartesian coordinates, when connected by smooth, continuing arcs, form complete main blade and splitter blade shapes that are substantially matched by the main blade 40 and splitter blade 42 shapes of compressor impeller 36 of the present invention.

Dimensional coordinates are found from the normalized Cartesian coordinates employed in the Tables by multiplying the Table values by radius R of the desired compressor impeller. Thus, the normalized coordinates employed in the tables are labeled X/R, Y/R, and Z/R to clearly indicate the relationship between the Table coordinates and those necessary to produce an actual compressor impeller. As mentioned above, radius R is the radial distance between center line $C_L$ and hub surface 70 at the most forward, or upstream, point of hub surface 70. Rotated about center line $C_L$, this defines plane (X/R)=0 for the Cartesian coordinate system employed in the Tables with X/R increasing in the aft direction. For main blade 40, Z/R represents the normalized distance from a plane containing center line $C_L$, the plane also parallel to a line tangential to hub surface 70 at the most forward, or upstream, point of hub surface 70, aligning with the center of main blade 40 at (X/R)=0. For splitter blade 42, Z/R represents the normalized distance from a plane containing center line $C_L$, the plane parallel to a line tangential to hub surface 70 at the most forward, or upstream, point of hub surface 70, midpoint on the circumference of hub surface 70 between adjacent main blades 40. Z/R is 0 at $C_L$. Y/R represents the normalized distance from a plane that contains center line $C_L$ and is perpendicular the Z/R plane. Following the right-hand rule, facing the aft direction, with values of Z/R increasing vertically, values of Y/R to the left are negative and values of Y/R to the right are positive.

Radius R values may vary widely depending on the desired application for compressor impeller 36. In one set of embodiments, R varies from about 0.5 inches (12.7 mm) to about 1.5 inches (38.1 mm). For embodiments employed as auxiliary power units for use with aircraft, R varies between about 1.0 inches (25.4 mm) to about 1.2 inches (30.5 mm). In another embodiment, R is 1.06±0.015 inches (26.9±0.4 mm).

Novel aspects of main blade 40 and splitter blade 42 of compressor 36 of the present invention described herein are achieved by substantial conformance to specified geometries. Substantial conformance generally includes or may include manufacturing tolerances of dimensional coordinates of about ±0.015 inches (±0.4 mm) and of normal thickness of ±0.008 inches (±0.2 mm) in order to account for variations in cutting, shaping, surface finishing and other manufacturing processes. This tolerance is absolute, and applies to all embodiments of compressor 36 regardless of size.

In particular, the manufacturing tolerance is applicable to main blade 40 or splitter blade 42 surfaces having a particular size and shape, as determined by selecting a particular radius R from within a specified range which are scalable to different sizes within that range. In these embodiments, substantial conformance is based on sets of points representing a three-dimensional surface with particular physical dimensions, for example in inches or millimeters, as determined by selecting particular values of radius R. A substantially conforming main blade 40 or splitter blade 42 has surfaces that conform to the specified sets of points, within the specified tolerance.

Alternatively, substantial conformance is based on a determination by a national or international regulatory body, for example in a part certification or parts manufacture approval (PMA) process for the Federal Aviation Administration, the European Aviation Safety Agency, the Civil Aviation Administration of China, the Japan Civil Aviation Bureau, or the Russian Federal Agency for Air Transport. In these embodiments, substantial conformance encompasses a determination that a particular compressor impeller is identical to, or sufficiently similar to, the specified compressor impeller 36 comprising main blades 40 and splitter blades 42, or that the compressor impeller is sufficiently the same with respect to a part design in a type-certified compressor impeller, such that the compressor impeller complies with airworthiness standards applicable to the specified compressor impeller. In particular, substantial conformance encompasses any regulatory determination that a particular part or structure is sufficiently similar to, identical to, or the same as a specified compressor impeller 36 of the present invention, such that certification or authorization for use is based at least in part on the determination of similarity.

TABLE 1

Normalized Coordinates - Main Blade Suction Surface Dimensional Coordinate Tolerance: ±0.015 inches (±0.4 mm); Normal Thickness Tolerance: ±0.008 inches (±0.2 mm)

| Section S1 | | | Section S2 | | | Section S3 | | |
|---|---|---|---|---|---|---|---|---|
| X/R | Y/R | Z/R | X/R | Y/R | Z/R | X/R | Y/R | Z/R |
| 0.000 | 0.011 | 1.000 | 0.000 | 0.009 | 1.192 | 0.000 | 0.007 | 1.383 |
| 0.094 | −0.034 | 1.010 | 0.090 | −0.040 | 1.200 | 0.085 | −0.047 | 1.390 |
| 0.187 | −0.080 | 1.021 | 0.179 | −0.091 | 1.209 | 0.170 | −0.103 | 1.397 |
| 0.280 | −0.127 | 1.034 | 0.267 | −0.144 | 1.219 | 0.254 | −0.162 | 1.405 |
| 0.372 | −0.177 | 1.048 | 0.355 | −0.199 | 1.230 | 0.338 | −0.222 | 1.413 |
| 0.464 | −0.228 | 1.063 | 0.442 | −0.255 | 1.242 | 0.421 | −0.283 | 1.421 |
| 0.554 | −0.280 | 1.079 | 0.529 | −0.313 | 1.254 | 0.503 | −0.346 | 1.429 |
| 0.643 | −0.333 | 1.097 | 0.614 | −0.371 | 1.267 | 0.585 | −0.410 | 1.437 |
| 0.732 | −0.387 | 1.115 | 0.699 | −0.430 | 1.280 | 0.666 | −0.473 | 1.445 |
| 0.819 | −0.440 | 1.135 | 0.782 | −0.488 | 1.294 | 0.745 | −0.536 | 1.453 |
| 0.904 | −0.495 | 1.155 | 0.864 | −0.547 | 1.309 | 0.824 | −0.599 | 1.463 |
| 0.989 | −0.550 | 1.178 | 0.945 | −0.606 | 1.325 | 0.902 | −0.662 | 1.472 |
| 1.071 | −0.605 | 1.201 | 1.025 | −0.665 | 1.342 | 0.979 | −0.724 | 1.483 |
| 1.153 | −0.662 | 1.226 | 1.104 | −0.724 | 1.360 | 1.054 | −0.786 | 1.494 |
| 1.233 | −0.719 | 1.252 | 1.181 | −0.784 | 1.379 | 1.128 | −0.848 | 1.507 |
| 1.311 | −0.778 | 1.279 | 1.256 | −0.844 | 1.400 | 1.201 | −0.910 | 1.521 |
| 1.387 | −0.838 | 1.308 | 1.330 | −0.905 | 1.422 | 1.273 | −0.972 | 1.536 |
| 1.461 | −0.899 | 1.337 | 1.402 | −0.966 | 1.445 | 1.343 | −1.034 | 1.552 |
| 1.533 | −0.962 | 1.368 | 1.472 | −1.029 | 1.469 | 1.411 | −1.096 | 1.569 |
| 1.603 | −1.026 | 1.400 | 1.540 | −1.093 | 1.494 | 1.478 | −1.160 | 1.588 |
| 1.671 | −1.093 | 1.433 | 1.607 | −1.158 | 1.520 | 1.542 | −1.223 | 1.608 |
| 1.737 | −1.161 | 1.466 | 1.671 | −1.225 | 1.548 | 1.605 | −1.288 | 1.629 |
| 1.799 | −1.231 | 1.500 | 1.732 | −1.293 | 1.576 | 1.666 | −1.354 | 1.651 |
| 1.859 | −1.303 | 1.535 | 1.792 | −1.362 | 1.605 | 1.724 | −1.422 | 1.674 |
| 1.917 | −1.378 | 1.570 | 1.848 | −1.434 | 1.634 | 1.780 | −1.491 | 1.698 |
| 1.971 | −1.454 | 1.606 | 1.902 | −1.508 | 1.664 | 1.833 | −1.561 | 1.722 |
| 2.022 | −1.533 | 1.641 | 1.953 | −1.583 | 1.694 | 1.884 | −1.634 | 1.747 |
| 2.070 | −1.615 | 1.675 | 2.001 | −1.662 | 1.724 | 1.932 | −1.708 | 1.772 |
| 2.115 | −1.700 | 1.709 | 2.046 | −1.743 | 1.753 | 1.977 | −1.785 | 1.796 |
| 2.156 | −1.788 | 1.741 | 2.087 | −1.827 | 1.780 | 2.019 | −1.865 | 1.820 |
| 2.193 | −1.880 | 1.770 | 2.126 | −1.914 | 1.806 | 2.058 | −1.948 | 1.842 |
| 2.227 | −1.975 | 1.798 | 2.160 | −2.004 | 1.830 | 2.093 | −2.033 | 1.863 |
| 2.258 | −2.073 | 1.822 | 2.191 | −2.098 | 1.852 | 2.125 | −2.122 | 1.882 |
| 2.285 | −2.175 | 1.842 | 2.219 | −2.195 | 1.870 | 2.153 | −2.214 | 1.898 |
| 2.308 | −2.281 | 1.859 | 2.243 | −2.295 | 1.885 | 2.178 | −2.310 | 1.911 |
| 2.327 | −2.390 | 1.871 | 2.263 | −2.399 | 1.896 | 2.199 | −2.408 | 1.921 |
| 2.343 | −2.502 | 1.878 | 2.279 | −2.506 | 1.902 | 2.216 | −2.510 | 1.926 |
| 2.355 | −2.617 | 1.879 | 2.292 | −2.616 | 1.903 | 2.229 | −2.614 | 1.926 |
| 2.364 | −2.737 | 1.872 | 2.301 | −2.730 | 1.897 | 2.238 | −2.723 | 1.921 |
| 2.369 | −2.860 | 1.858 | 2.306 | −2.847 | 1.883 | 2.244 | −2.834 | 1.909 |
| 2.371 | −2.987 | 1.834 | 2.308 | −2.968 | 1.861 | 2.245 | −2.950 | 1.888 |

TABLE 1-continued

Normalized Coordinates - Main Blade Suction Surface Dimensional
Coordinate Tolerance: ±0.015 inches (±0.4 mm); Normal
Thickness Tolerance: ±0.008 inches (±0.2 mm)

| Section S4 | | | Section S5 | | | Section S6 | | |
|---|---|---|---|---|---|---|---|---|
| X/R | Y/R | Z/R | X/R | Y/R | Z/R | X/R | Y/R | Z/R |
| 0.000 | 0.006 | 1.575 | 0.000 | 0.004 | 1.767 | 0.000 | 0.002 | 1.958 |
| 0.081 | −0.054 | 1.580 | 0.076 | −0.061 | 1.771 | 0.072 | −0.068 | 1.961 |
| 0.161 | −0.115 | 1.586 | 0.152 | −0.127 | 1.774 | 0.143 | −0.140 | 1.962 |
| 0.241 | −0.179 | 1.591 | 0.228 | −0.196 | 1.777 | 0.215 | −0.214 | 1.962 |
| 0.321 | −0.244 | 1.596 | 0.303 | −0.267 | 1.778 | 0.286 | −0.290 | 1.961 |
| 0.400 | −0.311 | 1.600 | 0.378 | −0.340 | 1.779 | 0.357 | −0.368 | 1.958 |
| 0.478 | −0.379 | 1.604 | 0.453 | −0.413 | 1.779 | 0.427 | −0.447 | 1.954 |
| 0.556 | −0.448 | 1.607 | 0.526 | −0.487 | 1.777 | 0.497 | −0.526 | 1.948 |
| 0.633 | −0.516 | 1.610 | 0.600 | −0.560 | 1.775 | 0.567 | −0.605 | 1.940 |
| 0.709 | −0.584 | 1.613 | 0.672 | −0.633 | 1.773 | 0.636 | −0.682 | 1.932 |
| 0.784 | −0.652 | 1.616 | 0.744 | −0.705 | 1.770 | 0.704 | −0.758 | 1.924 |
| 0.859 | −0.718 | 1.620 | 0.816 | −0.775 | 1.767 | 0.772 | −0.832 | 1.915 |
| 0.932 | −0.784 | 1.624 | 0.886 | −0.844 | 1.765 | 0.840 | −0.904 | 1.906 |
| 1.005 | −0.849 | 1.629 | 0.956 | −0.911 | 1.763 | 0.906 | −0.974 | 1.898 |
| 1.076 | −0.913 | 1.635 | 1.024 | −0.977 | 1.762 | 0.972 | −1.042 | 1.890 |
| 1.147 | −0.976 | 1.642 | 1.092 | −1.042 | 1.763 | 1.037 | −1.109 | 1.883 |
| 1.216 | −1.039 | 1.650 | 1.159 | −1.106 | 1.764 | 1.102 | −1.174 | 1.878 |
| 1.284 | −1.101 | 1.659 | 1.224 | −1.169 | 1.767 | 1.165 | −1.237 | 1.874 |
| 1.350 | −1.164 | 1.670 | 1.289 | −1.231 | 1.771 | 1.227 | −1.299 | 1.871 |
| 1.415 | −1.226 | 1.682 | 1.352 | −1.293 | 1.776 | 1.289 | −1.360 | 1.870 |
| 1.478 | −1.289 | 1.695 | 1.413 | −1.355 | 1.783 | 1.349 | −1.420 | 1.870 |
| 1.539 | −1.352 | 1.710 | 1.473 | −1.416 | 1.791 | 1.408 | −1.480 | 1.873 |
| 1.599 | −1.416 | 1.726 | 1.532 | −1.478 | 1.801 | 1.465 | −1.540 | 1.876 |
| 1.656 | −1.481 | 1.743 | 1.588 | −1.541 | 1.813 | 1.521 | −1.600 | 1.882 |
| 1.712 | −1.547 | 1.761 | 1.643 | −1.604 | 1.825 | 1.575 | −1.661 | 1.889 |
| 1.765 | −1.615 | 1.780 | 1.696 | −1.668 | 1.839 | 1.627 | −1.722 | 1.897 |
| 1.815 | −1.684 | 1.800 | 1.746 | −1.734 | 1.853 | 1.677 | −1.784 | 1.906 |
| 1.863 | −1.755 | 1.820 | 1.794 | −1.801 | 1.868 | 1.725 | −1.848 | 1.917 |
| 1.908 | −1.828 | 1.840 | 1.840 | −1.870 | 1.884 | 1.771 | −1.913 | 1.928 |
| 1.951 | −1.903 | 1.860 | 1.882 | −1.942 | 1.899 | 1.814 | −1.980 | 1.939 |
| 1.990 | −1.982 | 1.878 | 1.922 | −2.016 | 1.914 | 1.854 | −2.050 | 1.950 |
| 2.026 | −2.063 | 1.896 | 1.959 | −2.092 | 1.929 | 1.892 | −2.122 | 1.962 |
| 2.059 | −2.147 | 1.912 | 1.992 | −2.172 | 1.942 | 1.926 | −2.196 | 1.972 |
| 2.088 | −2.234 | 1.926 | 2.022 | −2.254 | 1.954 | 1.956 | −2.273 | 1.981 |
| 2.113 | −2.324 | 1.937 | 2.048 | −2.339 | 1.963 | 1.983 | −2.354 | 1.989 |
| 2.134 | −2.417 | 1.945 | 2.070 | −2.427 | 1.970 | 2.006 | −2.436 | 1.995 |
| 2.152 | −2.514 | 1.950 | 2.088 | −2.518 | 1.974 | 2.025 | −2.522 | 1.998 |
| 2.166 | −2.613 | 1.950 | 2.103 | −2.612 | 1.974 | 2.039 | −2.611 | 1.998 |
| 2.175 | −2.716 | 1.945 | 2.112 | −2.709 | 1.970 | 2.050 | −2.703 | 1.994 |
| 2.181 | −2.822 | 1.934 | 2.118 | −2.810 | 1.959 | 2.056 | −2.797 | 1.984 |
| 2.183 | −2.931 | 1.915 | 2.120 | −2.913 | 1.942 | 2.057 | −2.895 | 1.969 |

| Section S7 | | | Section S8 | | | Section S9 | | |
|---|---|---|---|---|---|---|---|---|
| X/R | Y/R | Z/R | X/R | Y/R | Z/R | X/R | Y/R | Z/R |
| 0.000 | 0.001 | 2.150 | 0.000 | −0.001 | 2.341 | 0.000 | −0.003 | 2.533 |
| 0.067 | −0.075 | 2.151 | 0.063 | −0.082 | 2.341 | 0.059 | −0.089 | 2.532 |
| 0.135 | −0.152 | 2.151 | 0.126 | −0.165 | 2.339 | 0.117 | −0.178 | 2.527 |
| 0.202 | −0.232 | 2.148 | 0.189 | −0.251 | 2.334 | 0.176 | −0.270 | 2.520 |
| 0.269 | −0.314 | 2.144 | 0.251 | −0.338 | 2.326 | 0.234 | −0.363 | 2.509 |
| 0.335 | −0.397 | 2.137 | 0.314 | −0.427 | 2.316 | 0.292 | −0.458 | 2.495 |
| 0.402 | −0.482 | 2.129 | 0.376 | −0.517 | 2.303 | 0.351 | −0.554 | 2.478 |
| 0.468 | −0.566 | 2.118 | 0.439 | −0.607 | 2.288 | 0.409 | −0.649 | 2.458 |
| 0.534 | −0.650 | 2.106 | 0.501 | −0.696 | 2.270 | 0.468 | −0.743 | 2.435 |
| 0.599 | −0.732 | 2.092 | 0.563 | −0.782 | 2.251 | 0.526 | −0.834 | 2.410 |
| 0.664 | −0.812 | 2.077 | 0.624 | −0.867 | 2.231 | 0.584 | −0.923 | 2.383 |
| 0.729 | −0.890 | 2.062 | 0.686 | −0.948 | 2.209 | 0.642 | −1.008 | 2.356 |
| 0.793 | −0.965 | 2.047 | 0.747 | −1.027 | 2.187 | 0.701 | −1.090 | 2.327 |
| 0.857 | −1.038 | 2.032 | 0.808 | −1.102 | 2.166 | 0.758 | −1.168 | 2.299 |
| 0.920 | −1.108 | 2.017 | 0.868 | −1.174 | 2.144 | 0.816 | −1.242 | 2.271 |
| 0.983 | −1.176 | 2.004 | 0.928 | −1.244 | 2.124 | 0.873 | −1.312 | 2.244 |
| 1.045 | −1.242 | 1.992 | 0.988 | −1.310 | 2.105 | 0.931 | −1.379 | 2.218 |
| 1.106 | −1.305 | 1.981 | 1.047 | −1.374 | 2.087 | 0.987 | −1.443 | 2.194 |
| 1.166 | −1.367 | 1.971 | 1.105 | −1.435 | 2.071 | 1.044 | −1.504 | 2.171 |
| 1.226 | −1.427 | 1.964 | 1.163 | −1.495 | 2.057 | 1.100 | −1.563 | 2.150 |
| 1.284 | −1.486 | 1.958 | 1.220 | −1.553 | 2.045 | 1.155 | −1.620 | 2.132 |
| 1.342 | −1.545 | 1.954 | 1.276 | −1.609 | 2.035 | 1.210 | −1.674 | 2.115 |
| 1.398 | −1.602 | 1.951 | 1.331 | −1.665 | 2.026 | 1.264 | −1.728 | 2.101 |
| 1.453 | −1.660 | 1.951 | 1.385 | −1.720 | 2.020 | 1.317 | −1.780 | 2.089 |
| 1.506 | −1.718 | 1.952 | 1.438 | −1.775 | 2.015 | 1.370 | −1.832 | 2.078 |
| 1.558 | −1.776 | 1.955 | 1.489 | −1.830 | 2.013 | 1.421 | −1.884 | 2.070 |

TABLE 1-continued

Normalized Coordinates - Main Blade Suction Surface Dimensional
Coordinate Tolerance: ±0.015 inches (±0.4 mm); Normal
Thickness Tolerance: ±0.008 inches (±0.2 mm)

| | | | | | | | | |
|---|---|---|---|---|---|---|---|---|
| 1.608 | −1.835 | 1.959 | 1.539 | −1.885 | 2.012 | 1.470 | −1.936 | 2.065 |
| 1.656 | −1.895 | 1.965 | 1.587 | −1.941 | 2.013 | 1.518 | −1.989 | 2.060 |
| 1.702 | −1.956 | 1.971 | 1.634 | −1.999 | 2.015 | 1.565 | −2.042 | 2.058 |
| 1.746 | −2.019 | 1.979 | 1.677 | −2.058 | 2.018 | 1.609 | −2.097 | 2.057 |
| 1.787 | −2.084 | 1.986 | 1.719 | −2.118 | 2.022 | 1.651 | −2.153 | 2.058 |
| 1.825 | −2.151 | 1.994 | 1.757 | −2.181 | 2.027 | 1.690 | −2.211 | 2.060 |
| 1.859 | −2.221 | 2.002 | 1.793 | −2.246 | 2.032 | 1.727 | −2.271 | 2.062 |
| 1.891 | −2.293 | 2.009 | 1.825 | −2.313 | 2.037 | 1.759 | −2.333 | 2.065 |
| 1.918 | −2.368 | 2.016 | 1.853 | −2.383 | 2.042 | 1.788 | −2.398 | 2.068 |
| 1.942 | −2.446 | 2.020 | 1.878 | −2.456 | 2.045 | 1.813 | −2.466 | 2.070 |
| 1.961 | −2.527 | 2.023 | 1.898 | −2.531 | 2.047 | 1.834 | −2.536 | 2.071 |
| 1.976 | −2.610 | 2.022 | 1.913 | −2.610 | 2.046 | 1.850 | −2.609 | 2.070 |
| 1.987 | −2.697 | 2.018 | 1.924 | −2.690 | 2.043 | 1.861 | −2.684 | 2.067 |
| 1.993 | −2.786 | 2.010 | 1.930 | −2.774 | 2.035 | 1.868 | −2.762 | 2.061 |
| 1.995 | −2.877 | 1.996 | 1.932 | −2.860 | 2.023 | 1.870 | −2.843 | 2.050 |

TABLE 2

Normalized Coordinates - Main Blade Pressure Surface Dimensional
Coordinate Tolerance: ±0.015 inches (±0.4 mm); Normal
Thickness Tolerance: ±0.008 inches (±0.2 mm)

| Section S1 | | | Section S2 | | | Section S3 | | |
|---|---|---|---|---|---|---|---|---|
| X/R | Y/R | Z/R | X/R | Y/R | Z/R | X/R | Y/R | Z/R |
| 0.000 | −0.011 | 1.000 | 0.000 | −0.012 | 1.192 | 0.000 | −0.013 | 1.383 |
| 0.094 | −0.078 | 1.007 | 0.090 | −0.083 | 1.198 | 0.085 | −0.087 | 1.388 |
| 0.187 | −0.144 | 1.014 | 0.179 | −0.152 | 1.203 | 0.170 | −0.161 | 1.392 |
| 0.280 | −0.209 | 1.021 | 0.267 | −0.221 | 1.208 | 0.254 | −0.234 | 1.395 |
| 0.372 | −0.271 | 1.028 | 0.355 | −0.288 | 1.213 | 0.338 | −0.305 | 1.397 |
| 0.464 | −0.332 | 1.036 | 0.442 | −0.353 | 1.218 | 0.421 | −0.375 | 1.400 |
| 0.554 | −0.390 | 1.045 | 0.529 | −0.416 | 1.224 | 0.503 | −0.443 | 1.402 |
| 0.643 | −0.446 | 1.056 | 0.614 | −0.478 | 1.230 | 0.585 | −0.509 | 1.405 |
| 0.732 | −0.501 | 1.068 | 0.699 | −0.538 | 1.238 | 0.666 | −0.573 | 1.408 |
| 0.819 | −0.556 | 1.083 | 0.782 | −0.596 | 1.248 | 0.745 | −0.637 | 1.412 |
| 0.904 | −0.609 | 1.099 | 0.864 | −0.654 | 1.259 | 0.824 | −0.699 | 1.418 |
| 0.989 | −0.663 | 1.118 | 0.945 | −0.712 | 1.271 | 0.902 | −0.760 | 1.424 |
| 1.071 | −0.717 | 1.138 | 1.025 | −0.769 | 1.285 | 0.979 | −0.821 | 1.432 |
| 1.153 | −0.772 | 1.160 | 1.104 | −0.826 | 1.300 | 1.054 | −0.880 | 1.441 |
| 1.233 | −0.827 | 1.183 | 1.181 | −0.884 | 1.318 | 1.128 | −0.940 | 1.452 |
| 1.311 | −0.883 | 1.209 | 1.256 | −0.941 | 1.336 | 1.201 | −0.999 | 1.464 |
| 1.387 | −0.941 | 1.236 | 1.330 | −1.000 | 1.357 | 1.273 | −1.058 | 1.477 |
| 1.461 | −1.000 | 1.264 | 1.402 | −1.059 | 1.378 | 1.343 | −1.118 | 1.492 |
| 1.533 | −1.060 | 1.294 | 1.472 | −1.119 | 1.401 | 1.411 | −1.178 | 1.509 |
| 1.603 | −1.122 | 1.324 | 1.540 | −1.181 | 1.425 | 1.478 | −1.239 | 1.527 |
| 1.671 | −1.187 | 1.356 | 1.607 | −1.244 | 1.451 | 1.542 | −1.301 | 1.546 |
| 1.737 | −1.253 | 1.388 | 1.671 | −1.309 | 1.477 | 1.605 | −1.364 | 1.566 |
| 1.799 | −1.322 | 1.421 | 1.732 | −1.376 | 1.504 | 1.666 | −1.429 | 1.587 |
| 1.859 | −1.393 | 1.454 | 1.792 | −1.444 | 1.531 | 1.724 | −1.495 | 1.608 |
| 1.917 | −1.467 | 1.487 | 1.848 | −1.516 | 1.559 | 1.780 | −1.564 | 1.631 |
| 1.971 | −1.544 | 1.519 | 1.902 | −1.589 | 1.586 | 1.833 | −1.634 | 1.653 |
| 2.022 | −1.624 | 1.551 | 1.953 | −1.665 | 1.613 | 1.884 | −1.707 | 1.675 |
| 2.070 | −1.706 | 1.582 | 2.001 | −1.744 | 1.640 | 1.932 | −1.782 | 1.698 |
| 2.115 | −1.792 | 1.612 | 2.046 | −1.826 | 1.666 | 1.977 | −1.859 | 1.719 |
| 2.156 | −1.881 | 1.640 | 2.087 | −1.910 | 1.690 | 2.019 | −1.939 | 1.740 |
| 2.193 | −1.973 | 1.666 | 2.126 | −1.998 | 1.713 | 2.058 | −2.022 | 1.760 |
| 2.227 | −2.068 | 1.690 | 2.160 | −2.088 | 1.734 | 2.093 | −2.108 | 1.778 |
| 2.258 | −2.166 | 1.710 | 2.191 | −2.182 | 1.752 | 2.125 | −2.197 | 1.794 |
| 2.285 | −2.268 | 1.727 | 2.219 | −2.279 | 1.767 | 2.153 | −2.289 | 1.807 |
| 2.308 | −2.373 | 1.740 | 2.243 | −2.378 | 1.779 | 2.178 | −2.384 | 1.818 |
| 2.327 | −2.480 | 1.749 | 2.263 | −2.481 | 1.787 | 2.199 | −2.481 | 1.825 |
| 2.343 | −2.591 | 1.752 | 2.279 | −2.587 | 1.790 | 2.216 | −2.582 | 1.827 |
| 2.355 | −2.705 | 1.749 | 2.292 | −2.696 | 1.787 | 2.229 | −2.686 | 1.825 |
| 2.364 | −2.823 | 1.739 | 2.301 | −2.808 | 1.778 | 2.238 | −2.793 | 1.816 |
| 2.369 | −2.944 | 1.721 | 2.306 | −2.924 | 1.761 | 2.244 | −2.904 | 1.801 |
| 2.371 | −3.068 | 1.693 | 2.308 | −3.043 | 1.735 | 2.245 | −3.018 | 1.777 |

TABLE 2-continued

Normalized Coordinates - Main Blade Pressure Surface Dimensional Coordinate Tolerance: ±0.015 inches (±0.4 mm); Normal Thickness Tolerance: ±0.008 inches (±0.2 mm)

| Section S4 | | | Section S5 | | | Section S6 | | |
|---|---|---|---|---|---|---|---|---|
| X/R | Y/R | Z/R | X/R | Y/R | Z/R | X/R | Y/R | Z/R |
| 0.000 | −0.014 | 1.575 | 0.000 | −0.015 | 1.766 | 0.000 | −0.017 | 1.958 |
| 0.081 | −0.092 | 1.579 | 0.076 | −0.096 | 1.769 | 0.072 | −0.100 | 1.959 |
| 0.161 | −0.169 | 1.581 | 0.152 | −0.177 | 1.770 | 0.143 | −0.185 | 1.959 |
| 0.241 | −0.246 | 1.582 | 0.228 | −0.258 | 1.769 | 0.215 | −0.270 | 1.956 |
| 0.321 | −0.322 | 1.582 | 0.303 | −0.338 | 1.766 | 0.286 | −0.354 | 1.951 |
| 0.400 | −0.396 | 1.581 | 0.378 | −0.417 | 1.762 | 0.357 | −0.438 | 1.944 |
| 0.478 | −0.469 | 1.580 | 0.453 | −0.495 | 1.758 | 0.427 | −0.520 | 1.936 |
| 0.556 | −0.540 | 1.579 | 0.526 | −0.570 | 1.752 | 0.497 | −0.600 | 1.926 |
| 0.633 | −0.609 | 1.577 | 0.600 | −0.644 | 1.747 | 0.567 | −0.679 | 1.916 |
| 0.709 | −0.677 | 1.577 | 0.672 | −0.716 | 1.741 | 0.636 | −0.756 | 1.905 |
| 0.784 | −0.743 | 1.576 | 0.744 | −0.787 | 1.735 | 0.704 | −0.830 | 1.894 |
| 0.859 | −0.808 | 1.577 | 0.816 | −0.856 | 1.730 | 0.772 | −0.903 | 1.882 |
| 0.932 | −0.872 | 1.578 | 0.886 | −0.923 | 1.725 | 0.840 | −0.973 | 1.872 |
| 1.005 | −0.934 | 1.581 | 0.956 | −0.988 | 1.722 | 0.906 | −1.041 | 1.862 |
| 1.076 | −0.996 | 1.585 | 1.024 | −1.052 | 1.719 | 0.972 | −1.107 | 1.853 |
| 1.147 | −1.057 | 1.591 | 1.092 | −1.114 | 1.718 | 1.037 | −1.171 | 1.845 |
| 1.216 | −1.117 | 1.598 | 1.159 | −1.175 | 1.718 | 1.102 | −1.233 | 1.839 |
| 1.284 | −1.177 | 1.606 | 1.224 | −1.236 | 1.720 | 1.165 | −1.294 | 1.834 |
| 1.350 | −1.237 | 1.616 | 1.289 | −1.296 | 1.724 | 1.227 | −1.354 | 1.831 |
| 1.415 | −1.297 | 1.628 | 1.352 | −1.356 | 1.729 | 1.289 | −1.413 | 1.830 |
| 1.478 | −1.358 | 1.640 | 1.413 | −1.415 | 1.735 | 1.349 | −1.472 | 1.830 |
| 1.539 | −1.420 | 1.654 | 1.473 | −1.475 | 1.743 | 1.408 | −1.530 | 1.832 |
| 1.599 | −1.483 | 1.670 | 1.532 | −1.536 | 1.752 | 1.465 | −1.589 | 1.835 |
| 1.656 | −1.546 | 1.686 | 1.588 | −1.597 | 1.763 | 1.521 | −1.648 | 1.840 |
| 1.712 | −1.612 | 1.702 | 1.643 | −1.660 | 1.774 | 1.575 | −1.708 | 1.846 |
| 1.765 | −1.679 | 1.720 | 1.696 | −1.724 | 1.787 | 1.627 | −1.769 | 1.853 |
| 1.815 | −1.748 | 1.738 | 1.746 | −1.789 | 1.800 | 1.677 | −1.831 | 1.862 |
| 1.863 | −1.819 | 1.755 | 1.794 | −1.857 | 1.813 | 1.725 | −1.894 | 1.871 |
| 1.908 | −1.893 | 1.773 | 1.840 | −1.926 | 1.827 | 1.771 | −1.959 | 1.881 |
| 1.951 | −1.969 | 1.790 | 1.882 | −1.998 | 1.841 | 1.814 | −2.026 | 1.891 |
| 1.990 | −2.047 | 1.807 | 1.922 | −2.072 | 1.854 | 1.854 | −2.096 | 1.901 |
| 2.026 | −2.128 | 1.822 | 1.959 | −2.148 | 1.866 | 1.892 | −2.168 | 1.911 |
| 2.059 | −2.212 | 1.836 | 1.992 | −2.227 | 1.878 | 1.926 | −2.242 | 1.920 |
| 2.088 | −2.299 | 1.848 | 2.022 | −2.309 | 1.888 | 1.956 | −2.319 | 1.928 |
| 2.113 | −2.389 | 1.857 | 2.048 | −2.394 | 1.895 | 1.983 | −2.399 | 1.934 |
| 2.134 | −2.482 | 1.863 | 2.070 | −2.482 | 1.901 | 2.006 | −2.482 | 1.938 |
| 2.152 | −2.578 | 1.865 | 2.088 | −2.573 | 1.902 | 2.025 | −2.568 | 1.940 |
| 2.166 | −2.676 | 1.863 | 2.103 | −2.666 | 1.900 | 2.039 | −2.656 | 1.938 |
| 2.175 | −2.778 | 1.855 | 2.112 | −2.763 | 1.893 | 2.050 | −2.748 | 1.931 |
| 2.181 | −2.884 | 1.840 | 2.118 | −2.863 | 1.880 | 2.056 | −2.842 | 1.920 |
| 2.183 | −2.992 | 1.819 | 2.120 | −2.966 | 1.860 | 2.057 | −2.940 | 1.902 |

| Section S7 | | | Section S8 | | | Section S9 | | |
|---|---|---|---|---|---|---|---|---|
| X/R | Y/R | Z/R | X/R | Y/R | Z/R | X/R | Y/R | Z/R |
| 0.000 | −0.018 | 2.150 | 0.000 | −0.019 | 2.341 | 0.000 | −0.020 | 2.533 |
| 0.067 | −0.105 | 2.150 | 0.063 | −0.109 | 2.340 | 0.059 | −0.113 | 2.531 |
| 0.135 | −0.193 | 2.147 | 0.126 | −0.200 | 2.336 | 0.117 | −0.207 | 2.525 |
| 0.202 | −0.281 | 2.142 | 0.189 | −0.293 | 2.329 | 0.176 | −0.303 | 2.516 |
| 0.269 | −0.370 | 2.135 | 0.251 | −0.385 | 2.319 | 0.234 | −0.399 | 2.504 |
| 0.335 | −0.458 | 2.125 | 0.314 | −0.477 | 2.306 | 0.292 | −0.495 | 2.488 |
| 0.402 | −0.544 | 2.113 | 0.376 | −0.568 | 2.291 | 0.351 | −0.591 | 2.469 |
| 0.468 | −0.630 | 2.100 | 0.439 | −0.658 | 2.274 | 0.409 | −0.685 | 2.448 |
| 0.534 | −0.713 | 2.085 | 0.501 | −0.746 | 2.254 | 0.468 | −0.778 | 2.424 |
| 0.599 | −0.794 | 2.069 | 0.563 | −0.832 | 2.233 | 0.526 | −0.868 | 2.398 |
| 0.664 | −0.873 | 2.052 | 0.624 | −0.915 | 2.211 | 0.584 | −0.955 | 2.371 |
| 0.729 | −0.949 | 2.035 | 0.686 | −0.995 | 2.189 | 0.642 | −1.039 | 2.342 |
| 0.793 | −1.023 | 2.019 | 0.747 | −1.072 | 2.166 | 0.701 | −1.120 | 2.313 |
| 0.857 | −1.094 | 2.002 | 0.808 | −1.146 | 2.143 | 0.758 | −1.196 | 2.284 |
| 0.920 | −1.162 | 1.987 | 0.868 | −1.216 | 2.121 | 0.816 | −1.269 | 2.256 |
| 0.983 | −1.228 | 1.973 | 0.928 | −1.283 | 2.100 | 0.873 | −1.338 | 2.228 |
| 1.045 | −1.291 | 1.960 | 0.988 | −1.348 | 2.081 | 0.931 | −1.404 | 2.202 |
| 1.106 | −1.353 | 1.949 | 1.047 | −1.410 | 2.063 | 0.987 | −1.467 | 2.178 |
| 1.166 | −1.412 | 1.939 | 1.105 | −1.470 | 2.047 | 1.044 | −1.527 | 2.155 |
| 1.226 | −1.471 | 1.931 | 1.163 | −1.528 | 2.033 | 1.100 | −1.585 | 2.134 |
| 1.284 | −1.528 | 1.925 | 1.220 | −1.585 | 2.020 | 1.155 | −1.640 | 2.116 |
| 1.342 | −1.585 | 1.921 | 1.276 | −1.640 | 2.010 | 1.210 | −1.694 | 2.099 |
| 1.398 | −1.642 | 1.918 | 1.331 | −1.695 | 2.002 | 1.264 | −1.747 | 2.085 |
| 1.453 | −1.699 | 1.917 | 1.385 | −1.749 | 1.995 | 1.317 | −1.799 | 2.073 |
| 1.506 | −1.755 | 1.918 | 1.438 | −1.803 | 1.990 | 1.370 | −1.850 | 2.063 |
| 1.558 | −1.813 | 1.920 | 1.489 | −1.857 | 1.987 | 1.421 | −1.901 | 2.055 |

TABLE 2-continued

Normalized Coordinates - Main Blade Pressure Surface Dimensional Coordinate Tolerance: ±0.015 inches (±0.4 mm); Normal Thickness Tolerance: ±0.008 inches (±0.2 mm)

| | | | | | | | | |
|---|---|---|---|---|---|---|---|---|
| 1.608 | −1.871 | 1.924 | 1.539 | −1.912 | 1.986 | 1.470 | −1.953 | 2.049 |
| 1.656 | −1.931 | 1.929 | 1.587 | −1.968 | 1.987 | 1.518 | −2.005 | 2.044 |
| 1.702 | −1.992 | 1.934 | 1.634 | −2.025 | 1.988 | 1.565 | −2.058 | 2.042 |
| 1.746 | −2.055 | 1.941 | 1.677 | −2.084 | 1.991 | 1.609 | −2.112 | 2.041 |
| 1.787 | −2.120 | 1.948 | 1.719 | −2.144 | 1.995 | 1.651 | −2.168 | 2.042 |
| 1.825 | −2.187 | 1.955 | 1.757 | −2.207 | 1.999 | 1.690 | −2.226 | 2.043 |
| 1.859 | −2.257 | 1.962 | 1.793 | −2.272 | 2.003 | 1.727 | −2.286 | 2.045 |
| 1.891 | −2.329 | 1.968 | 1.825 | −2.339 | 2.008 | 1.759 | −2.349 | 2.048 |
| 1.918 | −2.404 | 1.973 | 1.853 | −2.409 | 2.012 | 1.788 | −2.414 | 2.050 |
| 1.942 | −2.482 | 1.976 | 1.878 | −2.482 | 2.014 | 1.813 | −2.481 | 2.052 |
| 1.961 | −2.562 | 1.977 | 1.898 | −2.557 | 2.015 | 1.834 | −2.552 | 2.052 |
| 1.976 | −2.646 | 1.975 | 1.913 | −2.635 | 2.013 | 1.850 | −2.625 | 2.050 |
| 1.987 | −2.732 | 1.970 | 1.924 | −2.717 | 2.008 | 1.861 | −2.701 | 2.046 |
| 1.993 | −2.821 | 1.959 | 1.930 | −2.800 | 1.999 | 1.868 | −2.779 | 2.038 |
| 1.995 | −2.913 | 1.943 | 1.932 | −2.887 | 1.985 | 1.870 | −2.860 | 2.026 |

TABLE 3

Normalized Coordinates - Splitter Blade Suction Surface Dimensional Coordinate Tolerance: ±0.015 inches (±0.4 mm); Normal Thickness Tolerance: ±0.008 inches (±0.2 mm)

| Section S1 | | | Section S2 | | | Section S3 | | |
|---|---|---|---|---|---|---|---|---|
| X/R | Y/R | Z/R | X/R | Y/R | Z/R | X/R | Y/R | Z/R |
| 1.071 | −0.294 | 1.312 | 1.025 | −0.307 | 1.466 | 0.979 | −0.319 | 1.619 |
| 1.153 | −0.327 | 1.354 | 1.104 | −0.345 | 1.502 | 1.054 | −0.363 | 1.649 |
| 1.233 | −0.364 | 1.397 | 1.181 | −0.387 | 1.539 | 1.128 | −0.410 | 1.680 |
| 1.311 | −0.403 | 1.442 | 1.256 | −0.431 | 1.577 | 1.201 | −0.458 | 1.712 |
| 1.387 | −0.446 | 1.488 | 1.330 | −0.477 | 1.616 | 1.273 | −0.508 | 1.745 |
| 1.461 | −0.492 | 1.535 | 1.402 | −0.526 | 1.657 | 1.343 | −0.560 | 1.779 |
| 1.533 | −0.541 | 1.583 | 1.472 | −0.576 | 1.698 | 1.411 | −0.612 | 1.814 |
| 1.603 | −0.592 | 1.632 | 1.540 | −0.629 | 1.741 | 1.478 | −0.666 | 1.850 |
| 1.671 | −0.645 | 1.682 | 1.607 | −0.683 | 1.785 | 1.542 | −0.721 | 1.887 |
| 1.737 | −0.701 | 1.734 | 1.671 | −0.739 | 1.830 | 1.605 | −0.777 | 1.926 |
| 1.799 | −0.758 | 1.786 | 1.732 | −0.796 | 1.876 | 1.666 | −0.834 | 1.966 |
| 1.859 | −0.818 | 1.840 | 1.792 | −0.855 | 1.923 | 1.724 | −0.893 | 2.007 |
| 1.917 | −0.879 | 1.895 | 1.848 | −0.916 | 1.972 | 1.780 | −0.952 | 2.049 |
| 1.971 | −0.943 | 1.950 | 1.902 | −0.978 | 2.021 | 1.833 | −1.013 | 2.092 |
| 2.022 | −1.009 | 2.006 | 1.953 | −1.042 | 2.071 | 1.884 | −1.075 | 2.136 |
| 2.070 | −1.078 | 2.062 | 2.001 | −1.109 | 2.122 | 1.932 | −1.140 | 2.181 |
| 2.115 | −1.150 | 2.118 | 2.046 | −1.178 | 2.172 | 1.977 | −1.207 | 2.226 |
| 2.156 | −1.226 | 2.174 | 2.087 | −1.251 | 2.223 | 2.019 | −1.277 | 2.272 |
| 2.193 | −1.305 | 2.228 | 2.126 | −1.327 | 2.272 | 2.058 | −1.350 | 2.317 |
| 2.227 | −1.389 | 2.281 | 2.160 | −1.407 | 2.321 | 2.093 | −1.426 | 2.361 |
| 2.258 | −1.476 | 2.332 | 2.191 | −1.491 | 2.368 | 2.125 | −1.506 | 2.404 |
| 2.285 | −1.568 | 2.380 | 2.219 | −1.579 | 2.413 | 2.153 | −1.590 | 2.445 |
| 2.308 | −1.665 | 2.426 | 2.243 | −1.671 | 2.455 | 2.178 | −1.678 | 2.484 |
| 2.327 | −1.766 | 2.468 | 2.263 | −1.767 | 2.495 | 2.199 | −1.769 | 2.521 |
| 2.343 | −1.871 | 2.507 | 2.279 | −1.868 | 2.531 | 2.216 | −1.865 | 2.555 |
| 2.355 | −1.982 | 2.540 | 2.292 | −1.974 | 2.562 | 2.229 | −1.966 | 2.585 |
| 2.364 | −2.098 | 2.568 | 2.301 | −2.085 | 2.589 | 2.238 | −2.071 | 2.610 |
| 2.369 | −2.220 | 2.588 | 2.306 | −2.201 | 2.609 | 2.244 | −2.182 | 2.630 |
| 2.371 | −2.349 | 2.601 | 2.308 | −2.324 | 2.621 | 2.245 | −2.298 | 2.642 |

| Section S4 | | | Section S5 | | | Section S6 | | |
|---|---|---|---|---|---|---|---|---|
| X/R | Y/R | Z/R | X/R | Y/R | Z/R | X/R | Y/R | Z/R |
| 0.932 | −0.331 | 1.773 | 0.886 | −0.343 | 1.926 | 0.840 | −0.355 | 2.080 |
| 1.005 | −0.381 | 1.797 | 0.956 | −0.399 | 1.944 | 0.906 | −0.418 | 2.092 |
| 1.076 | −0.433 | 1.821 | 1.024 | −0.456 | 1.963 | 0.972 | −0.480 | 2.104 |
| 1.147 | −0.486 | 1.847 | 1.092 | −0.513 | 1.982 | 1.037 | −0.541 | 2.117 |
| 1.216 | −0.539 | 1.874 | 1.159 | −0.570 | 2.002 | 1.102 | −0.602 | 2.131 |
| 1.284 | −0.593 | 1.901 | 1.224 | −0.627 | 2.023 | 1.165 | −0.662 | 2.145 |
| 1.350 | −0.648 | 1.929 | 1.289 | −0.684 | 2.045 | 1.227 | −0.721 | 2.161 |
| 1.415 | −0.704 | 1.959 | 1.352 | −0.741 | 2.068 | 1.289 | −0.779 | 2.177 |
| 1.478 | −0.759 | 1.990 | 1.413 | −0.798 | 2.092 | 1.349 | −0.836 | 2.195 |
| 1.539 | −0.816 | 2.022 | 1.473 | −0.854 | 2.118 | 1.408 | −0.893 | 2.214 |
| 1.599 | −0.873 | 2.055 | 1.532 | −0.911 | 2.145 | 1.465 | −0.949 | 2.234 |
| 1.656 | −0.930 | 2.090 | 1.588 | −0.968 | 2.173 | 1.521 | −1.005 | 2.256 |
| 1.712 | −0.988 | 2.126 | 1.643 | −1.025 | 2.203 | 1.575 | −1.061 | 2.280 |

TABLE 3-continued

Normalized Coordinates - Splitter Blade Suction Surface
Dimensional Coordinate Tolerance: ±0.015 inches (±0.4 mm); Normal Thickness Tolerance: ±0.008 inches (±0.2 mm)

| | | | | | | | | |
|---|---|---|---|---|---|---|---|---|
| 1.765 | −1.048 | 2.163 | 1.696 | −1.083 | 2.234 | 1.627 | −1.118 | 2.305 |
| 1.815 | −1.108 | 2.202 | 1.746 | −1.142 | 2.267 | 1.677 | −1.175 | 2.332 |
| 1.863 | −1.171 | 2.241 | 1.794 | −1.202 | 2.300 | 1.725 | −1.233 | 2.359 |
| 1.908 | −1.235 | 2.280 | 1.840 | −1.264 | 2.334 | 1.771 | −1.293 | 2.388 |
| 1.951 | −1.302 | 2.321 | 1.882 | −1.328 | 2.369 | 1.814 | −1.354 | 2.418 |
| 1.990 | −1.372 | 2.361 | 1.922 | −1.395 | 2.405 | 1.854 | −1.417 | 2.449 |
| 2.026 | −1.445 | 2.400 | 1.959 | −1.464 | 2.440 | 1.892 | −1.483 | 2.480 |
| 2.059 | −1.521 | 2.439 | 1.992 | −1.536 | 2.475 | 1.926 | −1.552 | 2.511 |
| 2.088 | −1.601 | 2.477 | 2.022 | −1.612 | 2.509 | 1.956 | −1.623 | 2.542 |
| 2.113 | −1.684 | 2.513 | 2.048 | −1.691 | 2.543 | 1.983 | −1.698 | 2.572 |
| 2.134 | −1.771 | 2.548 | 2.070 | −1.773 | 2.574 | 2.006 | −1.776 | 2.601 |
| 2.152 | −1.862 | 2.579 | 2.088 | −1.860 | 2.604 | 2.025 | −1.857 | 2.628 |
| 2.166 | −1.958 | 2.608 | 2.103 | −1.950 | 2.630 | 2.039 | −1.942 | 2.653 |
| 2.175 | −2.058 | 2.632 | 2.112 | −2.045 | 2.653 | 2.050 | −2.032 | 2.675 |
| 2.181 | −2.163 | 2.651 | 2.118 | −2.144 | 2.671 | 2.056 | −2.125 | 2.692 |
| 2.183 | −2.273 | 2.663 | 2.120 | −2.248 | 2.684 | 2.057 | −2.223 | 2.705 |

| Section S7 | | | Section S8 | | | Section S9 | | |
|---|---|---|---|---|---|---|---|---|
| X/R | Y/R | Z/R | X/R | Y/R | Z/R | X/R | Y/R | Z/R |
| 0.793 | −0.367 | 2.233 | 0.747 | −0.378 | 2.387 | 0.701 | −0.390 | 2.540 |
| 0.857 | −0.436 | 2.240 | 0.808 | −0.454 | 2.387 | 0.758 | −0.473 | 2.535 |
| 0.920 | −0.503 | 2.246 | 0.868 | −0.527 | 2.388 | 0.816 | −0.552 | 2.529 |
| 0.983 | −0.569 | 2.253 | 0.928 | −0.598 | 2.388 | 0.873 | −0.627 | 2.523 |
| 1.045 | −0.634 | 2.260 | 0.988 | −0.666 | 2.388 | 0.931 | −0.699 | 2.517 |
| 1.106 | −0.696 | 2.268 | 1.047 | −0.731 | 2.390 | 0.987 | −0.767 | 2.512 |
| 1.166 | −0.757 | 2.276 | 1.105 | −0.794 | 2.392 | 1.044 | −0.832 | 2.507 |
| 1.226 | −0.817 | 2.286 | 1.163 | −0.855 | 2.395 | 1.100 | −0.894 | 2.504 |
| 1.284 | −0.875 | 2.297 | 1.220 | −0.914 | 2.399 | 1.155 | −0.953 | 2.502 |
| 1.342 | −0.932 | 2.310 | 1.276 | −0.971 | 2.406 | 1.210 | −1.011 | 2.501 |
| 1.398 | −0.988 | 2.324 | 1.331 | −1.027 | 2.413 | 1.264 | −1.066 | 2.502 |
| 1.453 | −1.043 | 2.340 | 1.385 | −1.081 | 2.423 | 1.317 | −1.120 | 2.506 |
| 1.506 | −1.098 | 2.357 | 1.438 | −1.135 | 2.434 | 1.370 | −1.172 | 2.510 |
| 1.558 | −1.153 | 2.376 | 1.489 | −1.189 | 2.447 | 1.421 | −1.224 | 2.517 |
| 1.608 | −1.208 | 2.397 | 1.539 | −1.242 | 2.462 | 1.470 | −1.276 | 2.526 |
| 1.656 | −1.264 | 2.419 | 1.587 | −1.296 | 2.478 | 1.518 | −1.327 | 2.537 |
| 1.702 | −1.321 | 2.442 | 1.634 | −1.350 | 2.496 | 1.565 | −1.379 | 2.550 |
| 1.746 | −1.380 | 2.467 | 1.677 | −1.406 | 2.516 | 1.609 | −1.432 | 2.565 |
| 1.787 | −1.440 | 2.493 | 1.719 | −1.463 | 2.537 | 1.651 | −1.486 | 2.581 |
| 1.825 | −1.502 | 2.520 | 1.757 | −1.522 | 2.559 | 1.690 | −1.541 | 2.599 |
| 1.859 | −1.567 | 2.547 | 1.793 | −1.582 | 2.583 | 1.727 | −1.598 | 2.619 |
| 1.891 | −1.634 | 2.574 | 1.825 | −1.646 | 2.606 | 1.759 | −1.657 | 2.639 |
| 1.918 | −1.705 | 2.601 | 1.853 | −1.711 | 2.630 | 1.788 | −1.718 | 2.660 |
| 1.942 | −1.778 | 2.628 | 1.878 | −1.780 | 2.654 | 1.813 | −1.783 | 2.681 |
| 1.961 | −1.855 | 2.653 | 1.898 | −1.852 | 2.677 | 1.834 | −1.850 | 2.702 |
| 1.976 | −1.935 | 2.676 | 1.913 | −1.927 | 2.699 | 1.850 | −1.920 | 2.722 |
| 1.987 | −2.019 | 2.696 | 1.924 | −2.006 | 2.718 | 1.861 | −1.993 | 2.740 |
| 1.993 | −2.106 | 2.713 | 1.930 | −2.088 | 2.734 | 1.868 | −2.070 | 2.755 |
| 1.995 | −2.199 | 2.726 | 1.932 | −2.174 | 2.747 | 1.870 | −2.150 | 2.768 |

TABLE 4

Normalized Coordinates - Splitter Blade Pressure Surface
Dimensional Coordinate Tolerance: ±0.015 inches (±0.4 mm); Normal Thickness Tolerance: ±0.008 inches (±0.2 mm)

| Section S1 | | | Section S2 | | | Section S3 | | |
|---|---|---|---|---|---|---|---|---|
| X/R | Y/R | Z/R | X/R | Y/R | Z/R | X/R | Y/R | Z/R |
| 1.071 | −0.316 | 1.307 | 1.025 | −0.329 | 1.461 | 0.979 | −0.342 | 1.614 |
| 1.153 | −0.377 | 1.341 | 1.104 | −0.393 | 1.490 | 1.054 | −0.409 | 1.638 |
| 1.233 | −0.434 | 1.377 | 1.181 | −0.453 | 1.520 | 1.128 | −0.472 | 1.664 |
| 1.311 | −0.490 | 1.415 | 1.256 | −0.511 | 1.553 | 1.201 | −0.533 | 1.690 |
| 1.387 | −0.544 | 1.455 | 1.330 | −0.568 | 1.587 | 1.273 | −0.591 | 1.719 |
| 1.461 | −0.597 | 1.497 | 1.402 | −0.622 | 1.623 | 1.343 | −0.648 | 1.749 |
| 1.533 | −0.650 | 1.541 | 1.472 | −0.676 | 1.661 | 1.411 | −0.703 | 1.781 |
| 1.603 | −0.703 | 1.587 | 1.540 | −0.730 | 1.701 | 1.478 | −0.758 | 1.814 |
| 1.671 | −0.756 | 1.635 | 1.607 | −0.785 | 1.743 | 1.542 | −0.813 | 1.850 |
| 1.737 | −0.811 | 1.685 | 1.671 | −0.840 | 1.786 | 1.605 | −0.868 | 1.887 |
| 1.799 | −0.868 | 1.736 | 1.732 | −0.896 | 1.830 | 1.666 | −0.924 | 1.925 |
| 1.859 | −0.927 | 1.787 | 1.792 | −0.955 | 1.876 | 1.724 | −0.982 | 1.965 |

TABLE 4-continued

Normalized Coordinates - Splitter Blade Pressure Surface
Dimensional Coordinate Tolerance: ±0.015 inches (±0.4 mm); Normal Thickness Tolerance: ±0.008 inches (±0.2 mm)

| | | | | | | | | |
|---|---|---|---|---|---|---|---|---|
| 1.917 | −0.989 | 1.840 | 1.848 | −1.015 | 1.923 | 1.780 | −1.041 | 2.005 |
| 1.971 | −1.054 | 1.893 | 1.902 | −1.078 | 1.970 | 1.833 | −1.102 | 2.046 |
| 2.022 | −1.121 | 1.946 | 1.953 | −1.143 | 2.017 | 1.884 | −1.166 | 2.088 |
| 2.070 | −1.192 | 1.999 | 2.001 | −1.211 | 2.065 | 1.932 | −1.231 | 2.131 |
| 2.115 | −1.265 | 2.052 | 2.046 | −1.282 | 2.113 | 1.977 | −1.300 | 2.174 |
| 2.156 | −1.343 | 2.104 | 2.087 | −1.357 | 2.160 | 2.019 | −1.371 | 2.216 |
| 2.193 | −1.424 | 2.155 | 2.126 | −1.434 | 2.207 | 2.058 | −1.445 | 2.259 |
| 2.227 | −1.508 | 2.204 | 2.160 | −1.515 | 2.252 | 2.093 | −1.522 | 2.300 |
| 2.258 | −1.597 | 2.251 | 2.191 | −1.600 | 2.296 | 2.125 | −1.603 | 2.340 |
| 2.285 | −1.690 | 2.296 | 2.219 | −1.688 | 2.337 | 2.153 | −1.687 | 2.379 |
| 2.308 | −1.786 | 2.338 | 2.243 | −1.781 | 2.377 | 2.178 | −1.775 | 2.416 |
| 2.327 | −1.887 | 2.377 | 2.263 | −1.877 | 2.413 | 2.199 | −1.867 | 2.450 |
| 2.343 | −1.993 | 2.411 | 2.279 | −1.978 | 2.446 | 2.216 | −1.963 | 2.481 |
| 2.355 | −2.103 | 2.441 | 2.292 | −2.083 | 2.474 | 2.229 | −2.063 | 2.508 |
| 2.364 | −2.219 | 2.464 | 2.301 | −2.194 | 2.497 | 2.238 | −2.169 | 2.530 |
| 2.369 | −2.340 | 2.481 | 2.306 | −2.310 | 2.513 | 2.244 | −2.279 | 2.546 |
| 2.371 | −2.467 | 2.489 | 2.308 | −2.431 | 2.522 | 2.245 | −2.395 | 2.555 |

| Section S4 | | | Section S5 | | | Section S6 | | |
|---|---|---|---|---|---|---|---|---|
| X/R | Y/R | Z/R | X/R | Y/R | Z/R | X/R | Y/R | Z/R |
| 0.932 | −0.355 | 1.768 | 0.886 | −0.369 | 1.921 | 0.840 | −0.382 | 2.075 |
| 1.005 | −0.425 | 1.787 | 0.956 | −0.441 | 1.935 | 0.906 | −0.457 | 2.084 |
| 1.076 | −0.491 | 1.807 | 1.024 | −0.510 | 1.950 | 0.972 | −0.528 | 2.093 |
| 1.147 | −0.554 | 1.828 | 1.092 | −0.575 | 1.965 | 1.037 | −0.596 | 2.103 |
| 1.216 | −0.614 | 1.850 | 1.159 | −0.638 | 1.982 | 1.102 | −0.661 | 2.114 |
| 1.284 | −0.673 | 1.874 | 1.224 | −0.698 | 2.000 | 1.165 | −0.722 | 2.126 |
| 1.350 | −0.730 | 1.900 | 1.289 | −0.756 | 2.020 | 1.227 | −0.782 | 2.139 |
| 1.415 | −0.785 | 1.928 | 1.352 | −0.813 | 2.041 | 1.289 | −0.840 | 2.154 |
| 1.478 | −0.841 | 1.957 | 1.413 | −0.869 | 2.064 | 1.349 | −0.896 | 2.171 |
| 1.539 | −0.896 | 1.987 | 1.473 | −0.924 | 2.088 | 1.408 | −0.952 | 2.189 |
| 1.599 | −0.952 | 2.020 | 1.532 | −0.980 | 2.114 | 1.465 | −1.007 | 2.209 |
| 1.656 | −1.009 | 2.053 | 1.588 | −1.036 | 2.141 | 1.521 | −1.063 | 2.230 |
| 1.712 | −1.067 | 2.088 | 1.643 | −1.093 | 2.170 | 1.575 | −1.118 | 2.253 |
| 1.765 | −1.126 | 2.123 | 1.696 | −1.151 | 2.200 | 1.627 | −1.175 | 2.277 |
| 1.815 | −1.188 | 2.160 | 1.746 | −1.210 | 2.231 | 1.677 | −1.232 | 2.302 |
| 1.863 | −1.251 | 2.197 | 1.794 | −1.271 | 2.263 | 1.725 | −1.290 | 2.329 |
| 1.908 | −1.316 | 2.235 | 1.840 | −1.333 | 2.296 | 1.771 | −1.350 | 2.356 |
| 1.951 | −1.384 | 2.273 | 1.882 | −1.398 | 2.329 | 1.814 | −1.412 | 2.385 |
| 1.990 | −1.455 | 2.311 | 1.922 | −1.465 | 2.362 | 1.854 | −1.475 | 2.414 |
| 2.026 | −1.529 | 2.348 | 1.959 | −1.535 | 2.396 | 1.892 | −1.542 | 2.444 |
| 2.059 | −1.605 | 2.385 | 1.992 | −1.608 | 2.429 | 1.926 | −1.610 | 2.474 |
| 2.088 | −1.686 | 2.420 | 2.022 | −1.684 | 2.462 | 1.956 | −1.682 | 2.503 |
| 2.113 | −1.769 | 2.454 | 2.048 | −1.763 | 2.493 | 1.983 | −1.757 | 2.532 |
| 2.134 | −1.857 | 2.486 | 2.070 | −1.846 | 2.523 | 2.006 | −1.835 | 2.559 |
| 2.152 | −1.948 | 2.515 | 2.088 | −1.933 | 2.550 | 2.025 | −1.917 | 2.585 |
| 2.166 | −2.043 | 2.541 | 2.103 | −2.023 | 2.574 | 2.039 | −2.003 | 2.608 |
| 2.175 | −2.144 | 2.562 | 2.112 | −2.118 | 2.595 | 2.050 | −2.093 | 2.627 |
| 2.181 | −2.249 | 2.578 | 2.118 | −2.218 | 2.610 | 2.056 | −2.187 | 2.642 |
| 2.183 | −2.358 | 2.588 | 2.120 | −2.322 | 2.620 | 2.057 | −2.285 | 2.653 |

| Section S7 | | | Section S8 | | | Section S9 | | |
|---|---|---|---|---|---|---|---|---|
| X/R | Y/R | Z/R | X/R | Y/R | Z/R | X/R | Y/R | Z/R |
| 0.793 | −0.396 | 2.228 | 0.747 | −0.409 | 2.381 | 0.701 | −0.423 | 2.535 |
| 0.857 | −0.473 | 2.232 | 0.808 | −0.489 | 2.380 | 0.758 | −0.504 | 2.529 |
| 0.920 | −0.547 | 2.236 | 0.868 | −0.565 | 2.379 | 0.816 | −0.582 | 2.522 |
| 0.983 | −0.617 | 2.240 | 0.928 | −0.637 | 2.378 | 0.873 | −0.656 | 2.515 |
| 1.045 | −0.683 | 2.245 | 0.988 | −0.705 | 2.377 | 0.931 | −0.727 | 2.509 |
| 1.106 | −0.747 | 2.251 | 1.047 | −0.771 | 2.377 | 0.987 | −0.794 | 2.503 |
| 1.166 | −0.808 | 2.259 | 1.105 | −0.833 | 2.378 | 1.044 | −0.858 | 2.498 |
| 1.226 | −0.867 | 2.268 | 1.163 | −0.893 | 2.381 | 1.100 | −0.919 | 2.494 |
| 1.284 | −0.924 | 2.278 | 1.220 | −0.951 | 2.385 | 1.155 | −0.978 | 2.492 |
| 1.342 | −0.980 | 2.290 | 1.276 | −1.007 | 2.391 | 1.210 | −1.034 | 2.492 |
| 1.398 | −1.035 | 2.303 | 1.331 | −1.062 | 2.398 | 1.264 | −1.089 | 2.493 |
| 1.453 | −1.089 | 2.318 | 1.385 | −1.116 | 2.407 | 1.317 | −1.142 | 2.496 |
| 1.506 | −1.144 | 2.335 | 1.438 | −1.169 | 2.418 | 1.370 | −1.194 | 2.500 |
| 1.558 | −1.198 | 2.353 | 1.489 | −1.222 | 2.430 | 1.421 | −1.245 | 2.507 |
| 1.608 | −1.254 | 2.373 | 1.539 | −1.275 | 2.445 | 1.470 | −1.297 | 2.516 |
| 1.656 | −1.310 | 2.395 | 1.587 | −1.329 | 2.461 | 1.518 | −1.348 | 2.527 |
| 1.702 | −1.367 | 2.417 | 1.634 | −1.383 | 2.478 | 1.565 | −1.399 | 2.539 |
| 1.746 | −1.425 | 2.441 | 1.677 | −1.439 | 2.497 | 1.609 | −1.452 | 2.554 |
| 1.787 | −1.486 | 2.466 | 1.719 | −1.495 | 2.518 | 1.651 | −1.505 | 2.570 |
| 1.825 | −1.548 | 2.492 | 1.757 | −1.554 | 2.540 | 1.690 | −1.560 | 2.588 |

TABLE 4-continued

| Normalized Coordinates - Splitter Blade Pressure Surface Dimensional Coordinate Tolerance: ±0.015 inches (±0.4 mm); Normal Thickness Tolerance: ±0.008 inches (±0.2 mm) | | | | | | | | |
|---|---|---|---|---|---|---|---|---|
| 1.859 | −1.613 | 2.518 | 1.793 | −1.615 | 2.562 | 1.727 | −1.617 | 2.607 |
| 1.891 | −1.680 | 2.544 | 1.825 | −1.678 | 2.585 | 1.759 | −1.676 | 2.627 |
| 1.918 | −1.751 | 2.570 | 1.853 | −1.745 | 2.609 | 1.788 | −1.738 | 2.647 |
| 1.942 | −1.825 | 2.595 | 1.878 | −1.814 | 2.632 | 1.813 | −1.803 | 2.668 |
| 1.961 | −1.902 | 2.619 | 1.898 | −1.886 | 2.654 | 1.834 | −1.870 | 2.688 |
| 1.976 | −1.982 | 2.641 | 1.913 | −1.962 | 2.674 | 1.850 | −1.941 | 2.707 |
| 1.987 | −2.067 | 2.660 | 1.924 | −2.041 | 2.692 | 1.861 | −2.015 | 2.724 |
| 1.993 | −2.155 | 2.675 | 1.930 | −2.124 | 2.707 | 1.868 | −2.092 | 2.738 |
| 1.995 | −2.248 | 2.685 | 1.932 | −2.211 | 2.718 | 1.870 | −2.173 | 2.750 |

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A compressor impeller comprising:

a hub having a radius;

a plurality of main blades connected to the hub, wherein each of the main blades is equally spaced around the circumference of the hub, each of the main blades comprising:

a suction surface formed in substantial conformance with normalized Cartesian coordinate values of X, Y, and Z set forth in Table 1; and a pressure surface formed in substantial conformance with normalized Cartesian coordinate values of X, Y, and Z set forth in Table 2; and a plurality of splitter blades connected to the hub, wherein each of the splitter blades is equally spaced around the circumference of the hub, and wherein each of the splitter blades is further equally spaced between two main blades, the two main blades being adjacent on the hub, each of the splitter blades comprising:

a suction surface formed in substantial conformance with normalized Cartesian coordinate values of X, Y, and Z set forth in Table 3; and a pressure surface formed in substantial conformance with normalized Cartesian coordinate values of X, Y, and Z set forth in Table 4;

wherein the normalized Cartesian coordinates, when connected by smooth, continuing arcs, form complete main blade and splitter blade shapes that are substantially matched by the main blade and splitter blade shapes of the compressor impeller.

2. The compressor impeller of claim 1, wherein each of the main blade and splitter blade surfaces are defined by scaling the set of Cartesian coordinates for the suction surface and the pressure surface to the radius R.

3. The compressor impeller of claim 2, wherein radius R is between 0.5 inches and 1.5 inches (or between 12.7 mm and 38.1 mm).

4. The compressor impeller of claim 2, wherein radius R is between 1.0 inches and 1.2 inches (or between 25.4 mm and 30.5 mm).

5. The compressor impeller of claim 2, wherein radius R is about 1.06±0.015 inches (or about 26.9±0.4 mm).

6. The compressor impeller of claim 1, wherein the plurality of main blades consists of eleven main blades and the plurality of splitter blades consists of eleven blades.

7. The compressor impeller of claim 1, wherein the suction and pressure surfaces of the main blade and the suction and pressure surfaces of the splitter blade are formed by machining, the machining employing a computer-controlled machining system capable of positioning control in five independent axes.

8. The compressor impeller of claim 1, wherein the compressor impeller is comprised of a single piece of forged titanium.

9. A compressor impeller blade set comprising:

a main blade, the main blade comprising:

a suction surface formed in substantial conformance with normalized Cartesian coordinate values of X, Y, and Z set forth in Table 1; and a pressure surface formed in substantial conformance with normalized Cartesian coordinate values of X, Y, and Z set forth in Table 2; and a splitter blade, the splitter blade comprising:

a suction surface formed in substantial conformance with normalized Cartesian coordinate values of X, Y, and Z set forth in Table 3; and a pressure surface formed in substantial conformance with normalized Cartesian coordinate values of X, Y, and Z set forth in Table 4;

wherein the normalized Cartesian coordinates, when connected by smooth, continuing arcs, form complete main blade and splitter blade shapes that are substantially matched by the main blade and splitter blade shapes of the compressor impellor blade set.

10. The compressor impeller blade set of claim 9, wherein the suction and pressure surfaces of the main blade and the suction and pressure surfaces of the splitter blade are formed by machining, the machining employing a computer-controlled machining system capable of positioning control in five independent axes.

11. The compressor impeller blade set of claim 9, wherein the blade set is comprised of forged titanium.

12. A method of manufacturing a compressor impeller, the method comprising:

machining a single piece of metal to a near net shape of the compressor impeller;

drilling the near net shaped metal piece to define a hub;

machining the drilled, near net shaped metal piece with a computer-controlled machining system capable of positioning control in five independent axes to form main blades and splitter blades in substantial conformance with normalized Cartesian coordinate values of X, Y, and Z set forth in Tables 1-4.

* * * * *